US008346123B2

(12) United States Patent
Okabe et al.

(10) Patent No.: US 8,346,123 B2
(45) Date of Patent: Jan. 1, 2013

(54) IMAGE FORMING APPARATUS AND PHOTOSENSITIVE UNIT

(75) Inventors: Yasushi Okabe, Nagoya (JP); Junichi Hashimoto, Toyohashi (JP); Isao Kishi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 434 days.

(21) Appl. No.: 12/625,587

(22) Filed: Nov. 25, 2009

(65) Prior Publication Data

US 2010/0135693 A1 Jun. 3, 2010

(30) Foreign Application Priority Data

Nov. 28, 2008 (JP) ..... 2008-304936

(51) Int. Cl.
*G03G 15/00* (2006.01)

(52) U.S. Cl. ..... 399/110

(58) Field of Classification Search ..... 399/111, 399/113, 119, 110
See application file for complete search history.

(56) References Cited

U.S. PATENT DOCUMENTS

| | | | |
|---|---|---|---|
| 6,708,011 | B2 | 3/2004 | Nomura et al. |
| 7,551,877 | B2 | 6/2009 | Murayama |
| 7,555,245 | B2 | 6/2009 | Kamimura |
| 7,567,769 | B2 | 7/2009 | Noguchi et al. |
| 7,715,755 | B2 | 5/2010 | Shiraki |
| 7,835,665 | B2 | 11/2010 | Okabe et al. |
| 2003/0053819 | A1 | 3/2003 | Nomura et al. |
| 2006/0029418 | A1 | 2/2006 | Ishii et al. |
| 2006/0029419 | A1 | 2/2006 | Shiraki |
| 2006/0029420 | A1 | 2/2006 | Ishii et al. |
| 2006/0029421 | A1 | 2/2006 | Ishii et al. |
| 2006/0029422 | A1 | 2/2006 | Shiraki |
| 2006/0029423 | A1 | 2/2006 | Shiraki |
| 2007/0071482 | A1 | 3/2007 | Okabe |
| 2007/0077086 | A1 | 4/2007 | Takakuwa et al. |

(Continued)

FOREIGN PATENT DOCUMENTS

CH 101042550 A 9/2007

(Continued)

OTHER PUBLICATIONS

Notification of Reason for Refusal dated Sep. 14, 2010 in Japanese Application No. 2008-304936 and partial English translation thereof.

(Continued)

*Primary Examiner* — Walter L Lindsay, Jr.
*Assistant Examiner* — Barnabas Fekete
(74) *Attorney, Agent, or Firm* — Banner & Witcoff, Ltd.

(57) ABSTRACT

An image forming apparatus is described. The image forming apparatus may include an image forming apparatus body and a photosensitive unit detachably mountable to the image forming apparatus body. The photosensitive unit includes: a frame; photosensitive bodies supported by the frame; cartridges including a developer carrier and detachably mountable to the frame; and a pressing portion provided on the frame for pressing the cartridges to direct the developer carrier toward the corresponding photosensitive body. Each cartridge can shift in the frame to a first attitude pressed by the pressing portion, and a second attitude released from the press of the pressing portion and detachable from the frame. The image forming apparatus body is provided with an abutment portion abutting the cartridge in the second attitude thereby bringing the cartridge into the first attitude when the photosensitive unit is mounted to the image forming apparatus body.

9 Claims, 9 Drawing Sheets

U.S. PATENT DOCUMENTS

| | | | | |
|---|---|---|---|---|
| 2007/0183814 | A1 | 8/2007 | Kamimura | |
| 2007/0217816 | A1 | 9/2007 | Shiraki | |
| 2007/0217818 | A1* | 9/2007 | Shiraki et al. | 399/111 |
| 2007/0280730 | A1 | 12/2007 | Okabe | |
| 2007/0286639 | A1 | 12/2007 | Murayama | |
| 2008/0159781 | A1 | 7/2008 | Noguchi et al. | |
| 2008/0170882 | A1 | 7/2008 | Ishii et al. | |
| 2008/0279583 | A1 | 11/2008 | Ishii et al. | |
| 2009/0169248 | A1 | 7/2009 | Ishii et al. | |

FOREIGN PATENT DOCUMENTS

| | | | |
|---|---|---|---|
| EP | 1 837 712 | A1 | 9/2007 |
| JP | 2003-015378 | A | 1/2003 |
| JP | 2007-101637 | | 4/2007 |
| JP | 2007-178654 | A | 7/2007 |
| JP | 2007-256351 | A | 10/2007 |
| JP | 2007-256352 | A | 10/2007 |
| JP | 2007-322554 | A | 12/2007 |
| JP | 2007-328300 | A | 12/2007 |
| JP | 2008-165027 | A | 7/2008 |
| JP | 2008-276273 | A | 11/2008 |

OTHER PUBLICATIONS

CH Office Action dtd Jul. 20, 2011, Chinese Application No. 200910246131.7, English Translation.

EP Office Action dated Aug. 19, 2011, corresponding Application No. 09176748.3.

JP Decision to Grant a Patent dtd Feb. 22, 2011, JP Appln. 2008-304936, partial English translation.

* cited by examiner

IMAGE FORMING APPARATUS AND PHOTOSENSITIVE UNIT

CROSS REFERENCE TO RELATED APPLICATION

The present application claims priority from Japanese Patent Application No. 2008-304936, which was filed on Nov. 28, 2008, the disclosure of which is incorporated herein by reference in its entirety.

TECHNICAL FIELD

The present invention relates to an image forming apparatus such as a laser printer and a photosensitive unit provided on the image forming apparatus.

BACKGROUND

A color laser printer having a plurality of photosensitive drums forming electrostatic images parallelly arranged in a prescribed direction is known as an image forming apparatus.

The color laser printer includes a drum unit integrally holding a plurality of photosensitive drums. A plurality of developer cartridges are detachably mounted to the drum unit. Each developer cartridge includes a developer roller, and the developer roller feeds a toner to an electrostatic latent image formed on the corresponding photosensitive drum for developing the electrostatic latent image.

The drum unit is detachably mountable to a main body casing of the color laser printer. When the drum unit is detached from the main body casing, the developer cartridge can be detachably mounted to the drum unit.

SUMMARY

In the color laser printer, the drum unit may be mounted to the main body casing while the developer cartridges are not completely mounted to the drum unit.

If any of the developer cartridges is not completely mounted to the drum unit when the drum unit is mounted to the main body casing, it is difficult for the developer roller of the developer cartridge to smoothly feed the toner to the electrostatic latent image formed on the corresponding photosensitive drum, and hence it is apprehended that the color laser printer cannot normally operate. In this case, the user must confirm whether or not the developer cartridges are completely mounted to the drum unit one by one respectively, to result in inferior handleability of the color laser printer.

One aspect of the present invention may provide an image forming apparatus capable of improving handleability in such a structure that a photosensitive unit detachably equipped with a cartridge is detachably mountable to an image forming apparatus body and a photosensitive unit provided on the image forming apparatus.

The same or different aspects of the present invention may provide an image forming apparatus including an image forming apparatus body and a photosensitive unit detachably mountable to the image forming apparatus body along a prescribed direction, wherein the photosensitive unit includes: a frame; a plurality of photosensitive bodies supported by the frame in a state parallelly arranged in the prescribed direction, on which electrostatic latent images are formed; a plurality of cartridges including a developer carrier opposed to the corresponding photosensitive body and detachably mountable to the frame; and a pressing portion provided on the frame for pressing the cartridges to direct the developer carrier toward the corresponding photosensitive body, each cartridge can shift in the frame to a first attitude pressed by the pressing portion and a second attitude released from the press of the pressing portion and detachable from the frame, and the image forming apparatus body is provided with an abutment portion abutting the cartridge in the second attitude thereby bringing the cartridge into the first attitude when the photosensitive unit is mounted to the image forming apparatus body.

One or more aspects of the present invention provide a photosensitive unit detachably mountable to an apparatus body of an image forming apparatus along a prescribed direction, including: a frame; a plurality of photosensitive bodies supported by the frame in a state parallelly arranged in the prescribed direction, on which electrostatic latent images are formed; a plurality of cartridges including a developer carrier opposed to the corresponding photosensitive body and detachably mountable to the frame; and a pressing portion provided on the frame for pressing the cartridges to direct the developer carrier toward the corresponding photosensitive body, wherein each cartridge can shift in the frame to a first attitude pressed by the pressing portion and a second attitude released from the press of the pressing portion and detachable from the frame, and includes an abutted portion abutted by the apparatus body when the photosensitive unit is mounted to the apparatus body while the cartridge is in the second attitude, and the cartridge in the second attitude is abutted by the apparatus body on the abutted portion thereby shifting from the second attitude to the first attitude when the photosensitive unit is mounted to the apparatus body.

DETAILED DESCRIPTION

Figure 1:
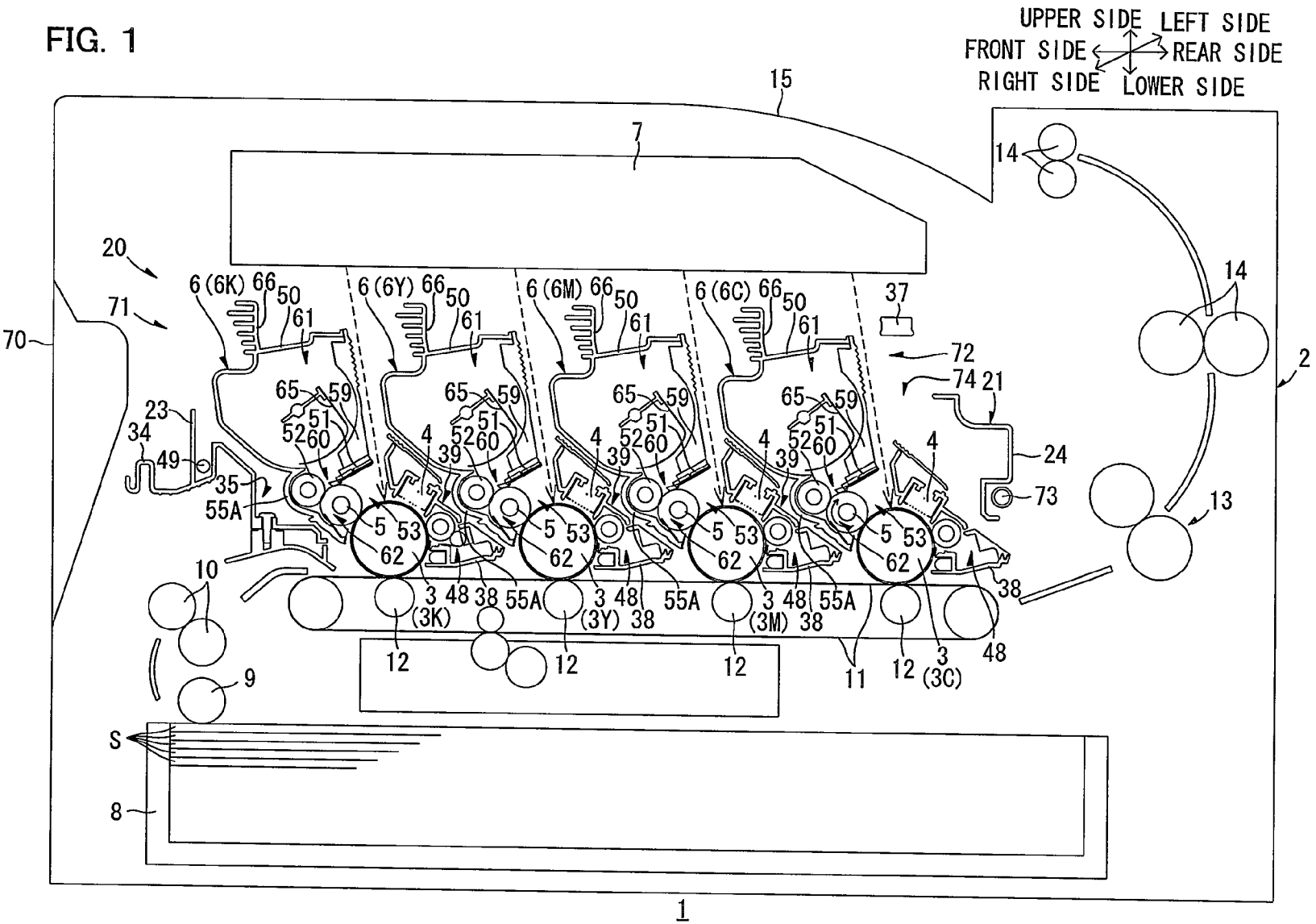
FIG. 1 is a side sectional view showing illustrative aspects of a printer as an example of an image forming apparatus of one or more aspects of the present invention.

An embodiment of one or more aspects of the present invention is now described with reference to the drawings.

<1. Printer>

In the following description, directions are mentioned with reference to arrows shown in the drawings (this also applies to other drawings). The left-and-right direction and the width direction are identical to each other, and the top-and-bottom direction and the vertical direction are identical to each other. The horizontal direction includes the width direction and the anteroposterior direction.

A printer 1 is a color printer. As shown in FIG. 1, the printer 1 is generally in the form of a box longitudinal in the anteroposterior direction, and includes a main body casing 2 as an example of an image forming apparatus body or an apparatus body. Four photosensitive drums 3 as examples of photosensitive bodies are parallelly arranged in the main body casing 2 along the anteroposterior direction in a rotatable state. In this state, each photosensitive drum 3 is longitudinal in the width direction. A scorotron charger 4 and a developer roller 5 as an example of a developer carrier are mainly opposed to each photosensitive drum 3.

A developer cartridge 6 holding the developer roller 5 and accommodating a toner as an example of a developer is arranged adjacently to each photosensitive drum 3. Four developer cartridges 6 functioning as examples of cartridges are provided similarly to the photosensitive drums 3. Each developer cartridge 6 is detachably mounted to the main body casing 2. In each developer cartridge 6, the toner is carried on the surface (the outer peripheral surface) of the developer roller 5.

In image formation, the surface of each photosensitive drum 3 is uniformly charged by the charger 4, and thereafter exposed by a laser beam (see each broken arrow in FIG. 1) emitted from a scanner unit 7 provided on an upper portion of the main body casing 2. Thus, an electrostatic latent image based on image data is formed on the surface of each photosensitive drum 3. The electrostatic latent image of each photosensitive drum 3 is visualized by the toner carried on the surface of the developer roller 5 corresponding to each photosensitive drum 3, and a toner image is formed on the surface of each photosensitive drum 3. In other words, the developer roller 5 develops the electrostatic latent image by feeding the toner to the corresponding photosensitive drum 3.

The developer cartridges 6 accommodate toners of different colors, i.e., black, cyan, magenta and yellow respectively. Therefore, the color of the toner image formed on each photosensitive drum 3 varies with the photosensitive drum 3.

In the following description, the four photosensitive drums 3 may be distinguished by the colors of the toner images formed thereon, as a photosensitive drum 3K (black), a photosensitive drum 3Y (yellow), a photosensitive drum 3M (magenta) and a photosensitive drum 3C (cyan). The photosensitive drums 3K, 3Y, 3M and 3C are arranged in this order from the front side. Further, the four developer cartridges 6 may also be distinguished by the colors, as a developer cartridge 6K (black), a developer cartridge 6Y (yellow), a developer cartridge 6M (magenta) and a developer cartridge 6C (cyan).

Sheets S as examples of recording media are stored in a sheet feed cassette 8 arranged on the bottom portion of the main body casing 2, in a vertically stacked state. In image formation, the uppermost sheet S of those stored in the sheet feed cassette 8 is delivered frontward by a sheet feeding roller 9 provided to face the front end portion of the sheet feed cassette 8 from above. The delivered sheet S moves up while changing the direction from the front side to the rear side.

Then, the sheet S enters the position between a pair of resist rollers 10. The pair of resist rollers 10 feed the sheet S toward a transport belt 11 provided on the rear side at prescribed timing.

The transport belt 11 is endless, and four transfer rollers 12 are arranged on an inner region thereof. The four transfer rollers 12 are parallelly arranged along the anteroposterior direction, and each transfer roller 12 is opposed to the corresponding photosensitive drum 3 from below through an upper portion of the transfer belt 11.

The sheet S fed from the pair of resist rollers 10 is transferred to the upper portion of the transport belt 11. The transport belt 11 cyclically moves clockwise in FIG. 1, thereby transporting the sheet S rearward on the upper portion. The toner images formed on the surfaces of the photosensitive drums 3 are transferred onto the sheet S transported by the transport belt 11 by transfer biases applied to the transfer rollers 12, and successively superposed. The colors of the toner images formed on the photosensitive drums 3 vary with the photosensitive drums 3, and hence the toner images of four colors are superposed on one another on the sheet S, and a color image is formed on the sheet S as a result.

The sheet S formed with the color image is transported by the transport belt 11 to a fixing section 13 provided on the rear side. The toner images transferred from the photosensitive drums 3 onto the sheet S are thermally fixed by the fixing section 13. Thereafter the sheet S is transported by a transport roller 14 to move up while changing the direction from the rear side to the front side, and ejected to a sheet ejection tray 15 provided on the upper portion of the main body casing 2.

<2. Process Unit>

The aforementioned photosensitive drums 3, chargers 4 and developer cartridges 6 are unified along with other components described below, to constitute a process unit 20 as an example of a photosensitive unit. The process unit 20 is detachably mountable to the main body casing 2 generally along the horizontal direction (the anteroposterior direction) (mounting of the process unit 20 is described later).

(1) Structure of Process Unit

The process unit 20 is divided into a drawer unit 21 as an example of a frame holding the photosensitive drums 3 and the chargers 4, and the aforementioned four developer cartridges 6. Each developer cartridge 6 is detachably mountable to the drawer unit 21 from above (as described later).

(1-1) Drawer Unit

Figure 2:
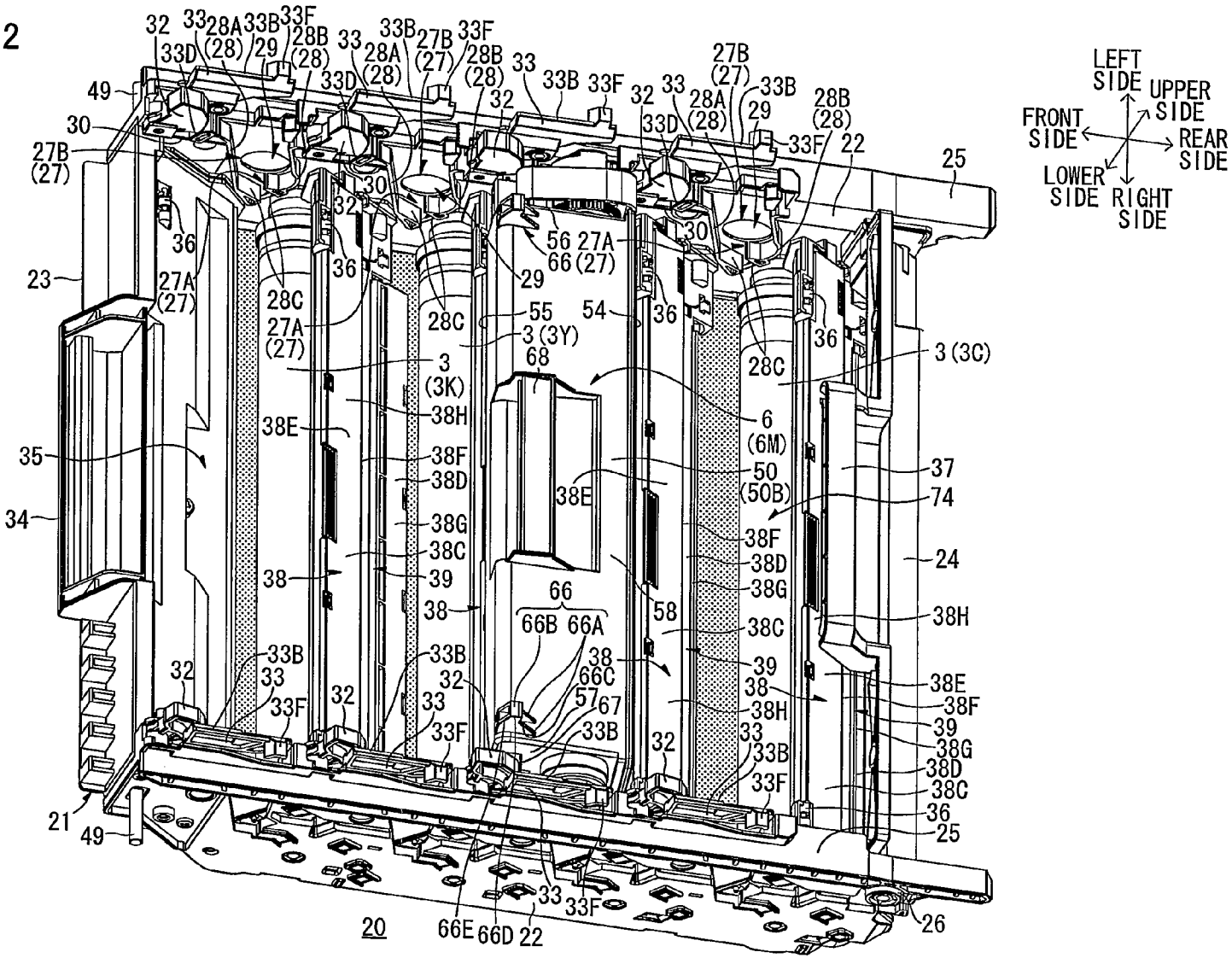
FIG. 2 is a perspective view of a process unit as viewed from the right front side.
Figure 3:
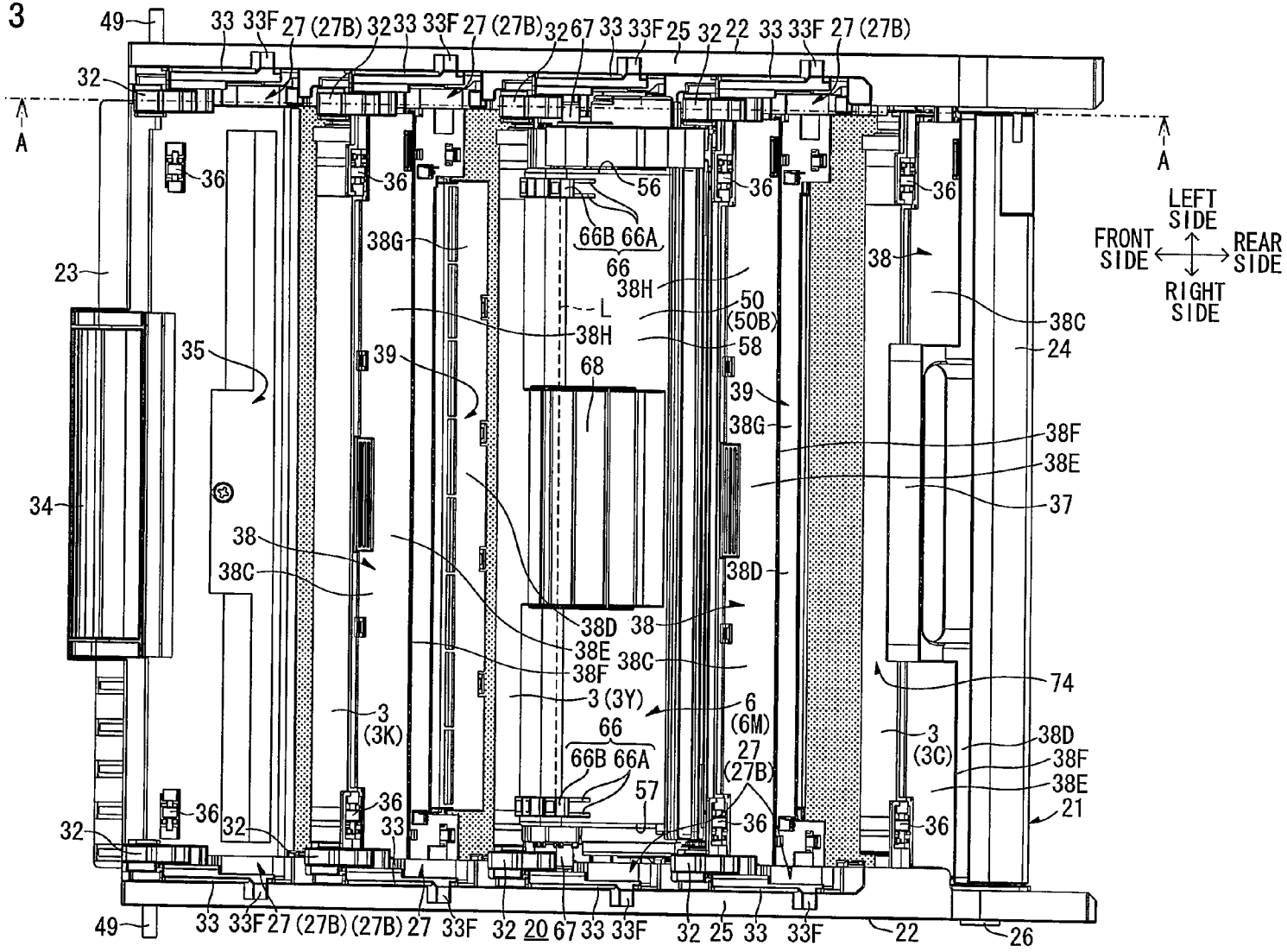
FIG. 3 is a plan view of the process unit.

The drawer unit 21 is in the form of an anteroposteriorly longitudinal box having a generally rectangular contour as viewed from above (see FIGS. 2 and 3). As shown in FIG. 2, the upper surface (the top surface) and the lower surface (the bottom surface) of the drawer unit 21 are opened, and the inner portion of the drawer unit 21 is exposed through the upper and lower surfaces. The opened upper surface of the drawer unit 21 is hereinafter referred to as an opening 74. Referring to FIG. 2, the opened lower surface of the drawer unit 21 is covered with dots (this also applies to FIG. 3).

The drawer unit 21 integrally includes a pair of side plates 22 as examples of side portions opposed to each other at an interval in the width direction, a front beam 23 extended between the front ends of the pair of side plates 22 and a rear beam 24 extended between the rear ends of the pair of side plates 22.

Each side plate 22 is generally vertically extending and generally in the form of a rectangle longitudinal in the anteroposterior direction. A guide rail 25 is integrally provided on the upper end edge of the side plate 22. The guide rail 25 is in the form of a bar longitudinal along the anteroposterior direction. The guide rail 25 is connected to the overall region of the upper end edge of the side plate 22 in the anteroposterior direction. In this state, an outer end of the guide rail 25 in the width direction protrudes outward beyond the side plate 22 in the width direction, while the rear end portion of the guide rail 25 protrudes rearward beyond the rear end of the side plate 22. The upper and lower surfaces of the guide rail 25 are planar along a generally horizontal direction. A roller 26 is rotatably provided on the lower surface of the rear end portion of the guide rail 25. The rotation axis of the roller 26 extends in the width direction.

Figure 4:
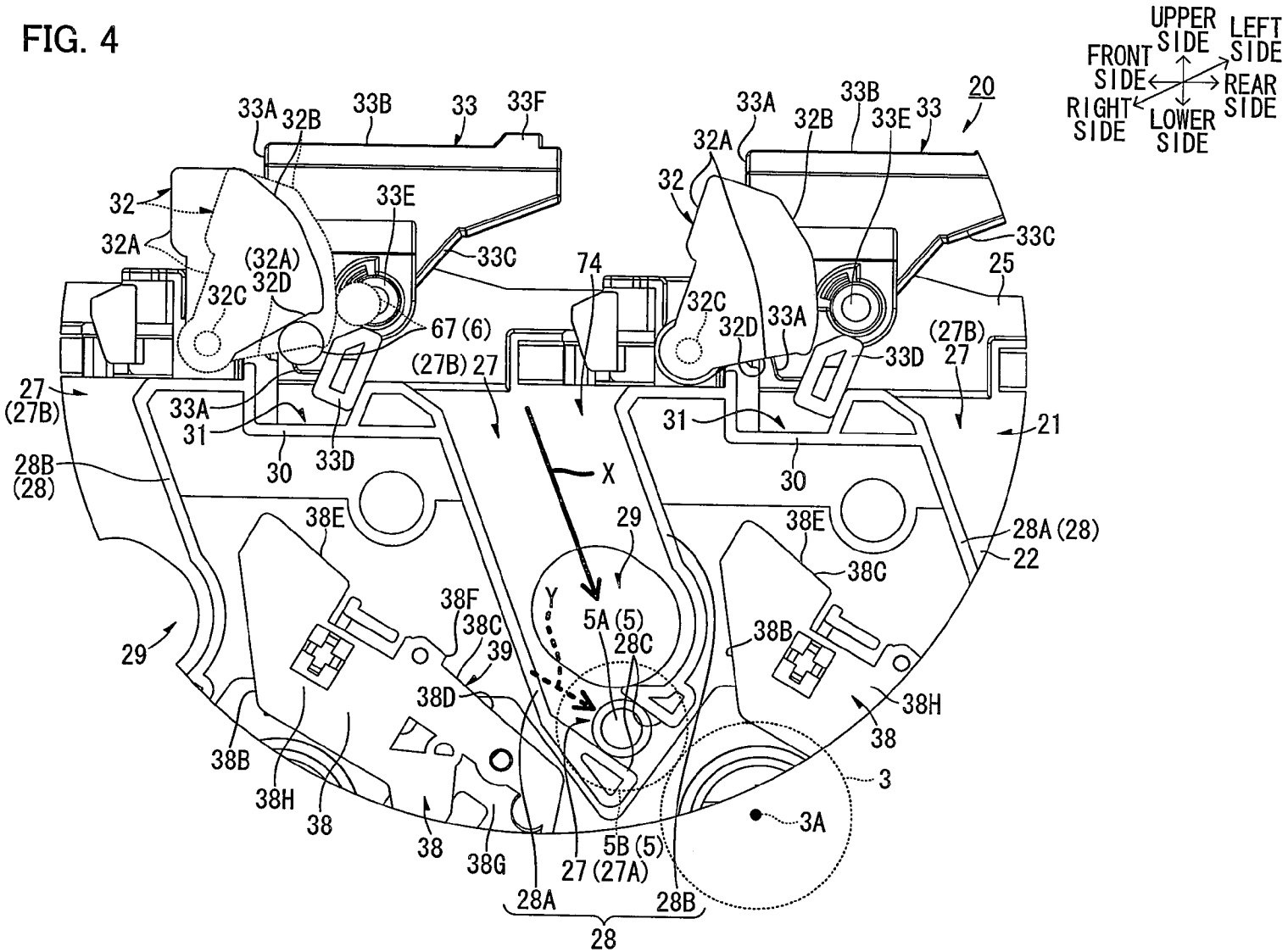
FIG. 4 is a partially fragmented sectional view taken along a line A-A in FIG. 3.

Guide grooves 27 are formed on the inner side surface of each side plate 22 in the width direction (see the left side plate 22). In each side plate 22, four guide grooves 27 are formed at regular intervals in the anteroposterior direction (the second guide groove 27 from the rear is hidden in the left side plate 22). As shown in FIG. 4, each guide groove 27 is continuous from the opening 74, and extends along a direction (a direction shown by a thick solid line, and the direction may hereinafter be referred to as a "first slant direction X") slightly toward the rear lower side between the upper end edge and a generally central position in the vertical direction at the side plate 22.

More specifically, in response to the number of the guide grooves 27, four pairs of guide ribs 28 extending along the first slant direction X anteroposteriorly at intervals to partition the corresponding guide groove 27 and protruding inward in the width direction, are formed on the inner side surface of the side plate 22 in the width direction (see also FIG. 2).

In each pair of guide ribs 28, that provided on the front side is referred to as a front rib 28A, and that provided on the rear side is referred to as a rear rib 28B. A region anteroposteriorly held between the front and rear ribs 28A and 28B defines each guide groove 27. The lower end portion of the front rib 28A is further inclined rearward as compared with the portion located above the same. A generally lower half of the rear rib 28B arcuately swells out rearward.

The lower end portion of the front rib 28A is opposed to the lower end portion of the rear rib 28B from the front lower side at a prescribed interval (generally corresponding to the diameter of a developer roller shaft 5A described later). When surfaces opposed to each other on the lower end portions of the front and rear ribs 28A and 28B are referred to as opposing surfaces 28C, the opposing surfaces 28C of the front and rear ribs 28A and 28B parallelly extend along a direction (a direction shown by a thick dotted line, and the direction may hereinafter be referred to as a "second slant direction Y") inclined rearward beyond the first slant direction X at the aforementioned prescribed interval.

In other words, each guide groove 27 includes a first portion 27A extending along the second slant direction Y and a second portion 27B extending along the first slant direction X. The second portion 27B is an upper portion continuous from the opening 74 in the guide groove 27, while the first portion 27A is continuous to the lower end of the second portion 27B, and forms the lower end portion of the guide groove 27. The first and second slant directions X and Y intersect with each other, and hence it is understood that the second portion 27B extends in a direction intersecting with the first portion 27A.

The first portion 27A may not be directly continuous to the lower end of the second portion 27B, while the guide groove 27 may include not only the first and second portions 27A and 27B, but also a third portion (not shown) connecting the first and second portions 27A and 27B with each other.

In the left side plate 22, an insertional opening 29 passing through the side plate 22 in the width direction and facing the guide groove 27 is formed in the vicinity of the lower end portion of each guide groove 27 (in the vicinity of a portion of the corresponding rear rib 28B arcuately swelling out rearward).

An extended portion 30 is integrally provided on the upper end edge of the front rib 28A. The extended portion 30 extends frontward continuously from the upper end edge of the front rib 28A. A recess portion 31 concaved downward is formed on the upper surface of the extended portion 30. As viewed from the width direction, a portion partitioning the front side of the recess portion 31 is a generally vertical surface, a portion partitioning the lower side of the recess portion 31 is a generally horizontal surface, and a portion partitioning the rear side of the recess portion 31 is an inclined surface extending toward the rear upper side.

While the four pairs of guide ribs 28 are formed on the inner side surface of the side plate 22 in the width direction (see also FIG. 2) as hereinabove described, the extended portion 30 connects the upper end edge of the front rib 28A of the rear guide rib 28 with the upper end edge of the rear rib 28B of the front guide rib 28 in each pair of guide ribs 28 anteroposteriorly adjacent to each other.

On the inner side surface of each side plate 22 in the width direction, a pressing cam 32 and a detaching cam 33 are provided on a position adjacent to the extended portion 30 of the front rib 28A corresponding to each guide groove 27 from above. Each side plate 22 has four guide grooves 27, and hence four pressing cams 32 and four detaching cams 33 are provided at each side plate 22 (see FIG. 2).

Each pressing cam 32 is generally sectorial as viewed from the width direction. Referring to the rear pressing cam 32 shown in FIG. 4, the contour of the pressing cam 32 as viewed from the width direction is partitioned by a pair of plane (generally plane) portions 32A at an interval widened toward the rear upper side and a curved surface portion 32B connecting the rear upper ends of the plane portions 32A with each other and arcuately swelling out toward the rear upper side.

The pressing cam 32 has a pivot shaft 32C extending outward in the width direction in the vicinity of a portion connecting the front lower ends of the pair of plane portions 32A with each other. The pivot shaft 32C is supported by the inner side surface of the corresponding side plate 22 in the width direction. Thus, the pressing cam 32 is pivotable on the pivot shaft 32C. More specifically, the pressing cam 32 is pivotable between a standby attitude taken by the rear pressing cam 32 in FIG. 4 and a pressing attitude taken by the front pressing cam 32 (see the solid line) in FIG. 4. Referring to the front pressing cam 32 in FIG. 4, the pressing attitude (see the solid line) is a state where the pressing cam 32 pivots toward the front upper side from the standby attitude (see the dotted line). In general, the pressing cam 32 is urged by an urging member (not shown) in a direction for shifting from the pressing attitude to the standby attitude.

In the pair of plane portions 32A of the pressing cam 32, the lower plane portion 32A is referred to as a pressing surface 32D as an example of a pressing portion. When the pressing cam 32 is urged in the direction for shifting from the pressing attitude to the standby attitude as hereinabove described, the pressing surface 32D is urged toward the recess portion 31 of the corresponding extended portion 30.

The detaching cam 33 is adjacent to the corresponding pressing cam 32 from the rear side and from the outer side in the width direction in a noncontact state. The detaching cam 33 is generally in the form of a right triangle having a right-angled portion on the front upper end as viewed from the width direction. In other words, the contour of the detaching cam 33 as viewed from the width direction is partitioned by a generally vertically extending vertical portion 33A, a horizontal portion 33B generally horizontally extending rearward from the upper end of the vertical portion 33A and an inclined portion 33C continuously extending from the rear end of the horizontal portion 33B toward the front lower side to be connected to the lower end of the vertical portion 33A. The horizontal portion 33B is positioned upward beyond the guide rail 25 provided on the upper end edge of the corresponding side plate 22 (see FIG. 2).

A detaching portion 33D is integrally provided on the lower end of the inclined portion 33C. The detaching portion 33D protrudes outward from the detaching cam 33 in the width direction, and is generally in the form of a trapezoid notched on the front side of the upper end portion as viewed from the width direction. The detaching portion 33D is located on the same position as the pressing cam 32 in the width direction.

The detaching cam 33 has a pivot shaft 33E extending outward in the width direction on the upper side of the detaching portion 33D in the inclined portion 33C. The pivot shaft 33E is supported by the inner side surface of the corresponding side plate 22 in the width direction. Thus, the detaching cam 33 is pivotable on the pivot shaft 33E. More specifically, the detaching cam 33 is pivotable between a standby attitude shown in FIG. 4 and a detaching attitude (not shown).

When the detaching cam 33 is in the standby attitude, the detaching portion 33D is fitted in the recess portion 31 of the corresponding extended portion 30, and inclined toward the rear upper side along the inclined surface partitioning the rear side of the recess portion 31. When the detaching cam 33 is in the detaching attitude (not shown), the detaching portion 33D deviates toward the front upper side from the position in the standby attitude. The deviating direction (the direction toward the front upper side) of the detaching portion 33D is generally parallel to the aforementioned second slant direction Y (see thick dotted arrow). In general, the detaching cam 33 is urged by an urging member (not shown) in a direction for shifting from the detaching attitude to the standby attitude.

A projection 33F protruding upward and outward in the width direction is integrally provided on the rear end of the horizontal portion 33B of the detaching cam 33 (see also FIG. 2).

When the pressing cam 32 and the detaching cam 33 are both in the standby attitudes, referring to the rear pressing cam 32 and the rear detaching cam 33 in FIG. 4, the lower end portion of the curved surface portion 32B of the pressing cam 32 is opposed to the front side surface of the detaching portion 33D of the detaching cam 33 at a small interval.

The front beam 23 is extended between the front ends of the pair of side plates 22, as shown in FIG. 2 and as hereinabove described. In the front beam 23, the front surface is a generally vertical surface, and the rear surface is inclined toward the rear lower side over the whole area thereof. A handle (referred to as a front handle 34) is provided at the center of the front surface of the front beam 23 in the width direction.

A recess 35 concaved toward the front lower side is formed on the lower side of the rear surface of the front beam 23. The recess 35 is formed generally over the whole area of the rear surface of the front beam 23 in the width direction. On both end portions of the rear surface of the front beam 23 in the width direction, rollers 36 are rotatably provided above the recess 35. The rotation axes of the rollers 36 extend along the width direction.

The lower end (the rear end) of the rear surface of the front beam 23 is adjacent to the lower end portion of the frontmost guide groove 27 of each side plate 22 from the front side. A positioning shaft 49 extending in the width direction is inserted into the front beam 23, and both end portions of the positioning shaft 49 in the width direction pass through the front end portions of the left and right side plates 22 to be exposed outward in the width direction.

The rear beam 24 is extended between the rear ends of the pair of side plates 22, as hereinabove described. A handle (referred to as a rear handle 37) inclinedly extending toward the front upper side is provided on the center of the upper end of the rear beam 24 in the width direction.

In a region held between the front beam 23 and the rear beam 24 in the anteroposterior direction, the aforementioned four photosensitive drums 3 are parallelly arranged at prescribed intervals in the anteroposterior direction (the second photosensitive drum 3 from the rear is hidden in FIG. 2). In this state, each photosensitive drum 3 is extended between the pair of side plates 22 on the rear lower side of the lower end of the guide groove 27 corresponding thereto in the anteroposterior direction, and rotatably supported by the pair of side plates 22 (i.e., the drawer unit 21). The rotation axis of each photosensitive drum 3 extends along the width direction. The outer peripheral surface of the lower side of each photosensitive drum 3 is exposed downward through the opened lower surface (see the portion covered with the dots in FIG. 2) of the drawer unit 21.

Each photosensitive drum 3 is extended between the pair of side plates 22, and hence it is understood that the pair of side plates 22 are arranged on both sides of each photosensitive drum 3 in the width direction. Each photosensitive drum 3 is on the rear lower side of the lower end of the guide groove 27 corresponding thereto in the anteroposterior direction, and hence the opened upper surface (the opening 74) of the drawer unit 21 is on a side opposite to the four photosensitive drums 3 in the vertical direction (an orthogonal direction to both of the anteroposterior direction and the width direction).

A beam member 38 is opposed to each photosensitive drum 3 from the rear upper side. In other words, four beam members 38 are provided in the drawer unit 21, similarly to the photosensitive drums 3 (see FIG. 1). Each beam member 38 is extended between the pair of side plates 22.

Each beam member 38 is now described with reference to the frontmost beam member 38 in FIG. 5B.

Each beam member 38 has a generally triangular section as viewed from the width direction. More specifically, the contour of each beam member 38 as viewed from the width direction is partitioned by a generally horizontally extending lower wall 38A, a front wall 38B extending upward from the front end of the lower wall 38A and a rear wall 38 extending from the upper end of the front wall 38B toward the rear lower side (a direction generally parallel to the aforementioned second slant direction Y, see FIG. 4) to be connected to the rear end of the lower wall 38A. In each beam member 38, the front wall 38B is opposed to the corresponding photosensitive drum 3 from the rear upper side.

The generally lower half of the rear wall 38C is concaved by one step as compared with the generally upper half thereof. In other words, a recess 39 concaved toward the front lower side is formed on the generally lower half of the rear wall 38C. In the rear wall 38C, the generally lower half (a portion formed with the recess 39, and the portion is referred to as a lower rear wall 38D as an example of a third wall) and the generally upper half (a portion not formed with the recess 39, and the portion is referred to as an upper rear wall 38E as an example of a fourth wall) are generally parallel to each other. In other words, the upper rear wall 38E is adjacent to the lower rear wall 38D from above through a bump portion (referred to as a second bump portion 38F), and protrudes (deviates) toward the rear upper side beyond the lower rear wall 38D.

The aforementioned rollers 36 are rotatably provided on both end portions of the upper rear wall 38E in the width direction (see FIG. 2).

In the following description, the generally lower half of each beam member 38 coinciding with the lower rear wall 38D (the recess 39) is referred to as a first portion 38G, and the generally upper half thereof coinciding with the upper rear wall 38E (not coinciding with the recess 39) is referred to as a second portion 38H.

Each beam member 38 holds the aforementioned charger 4 and a cleaning unit 48.

Figure 5A:
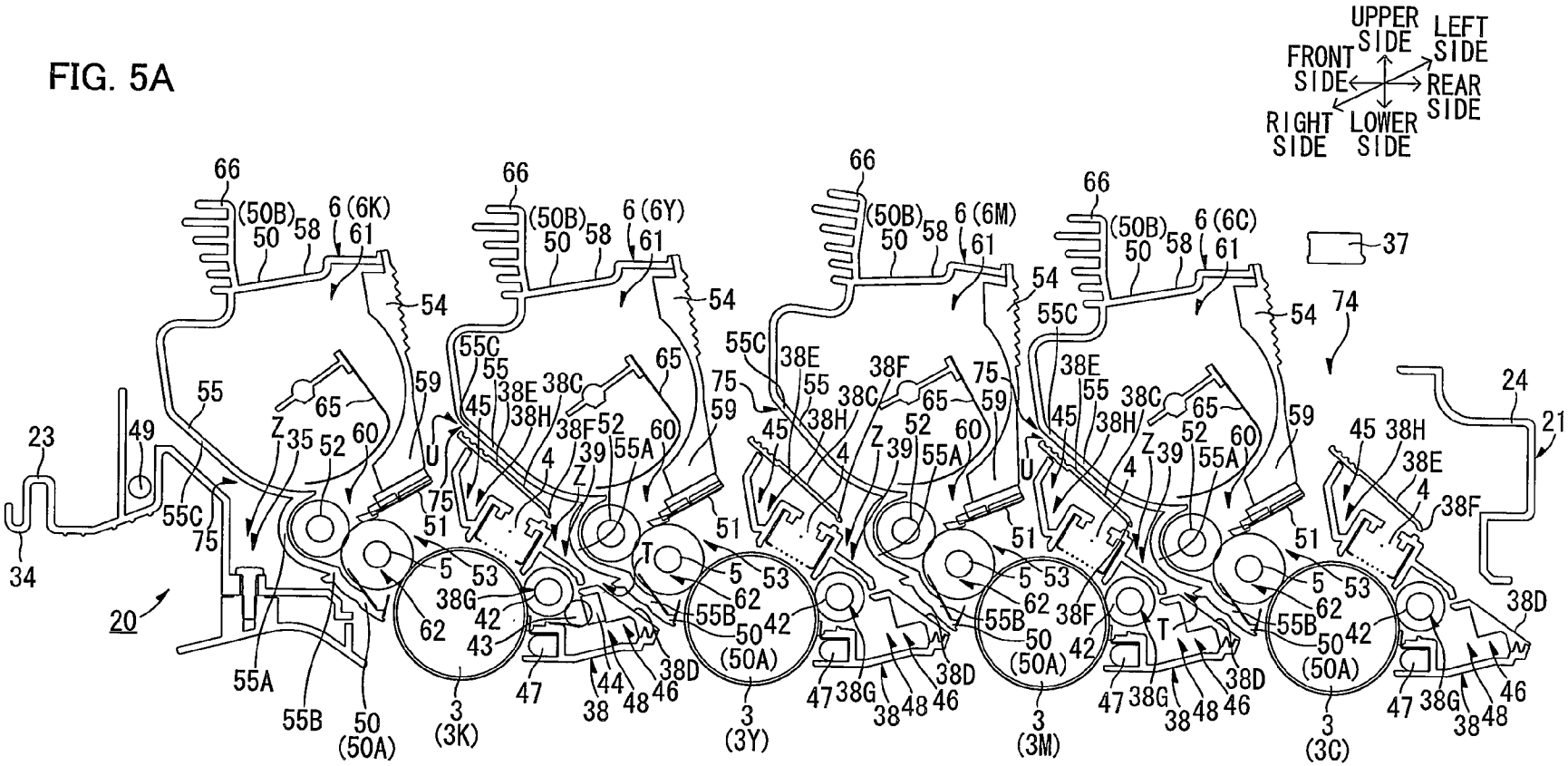
FIG. 5A is a right side sectional view of the process unit, showing a state where only the second developer cartridge from the rear is in a second attitude (the remaining developer cartridges are in first attitude).
Figure 5B:
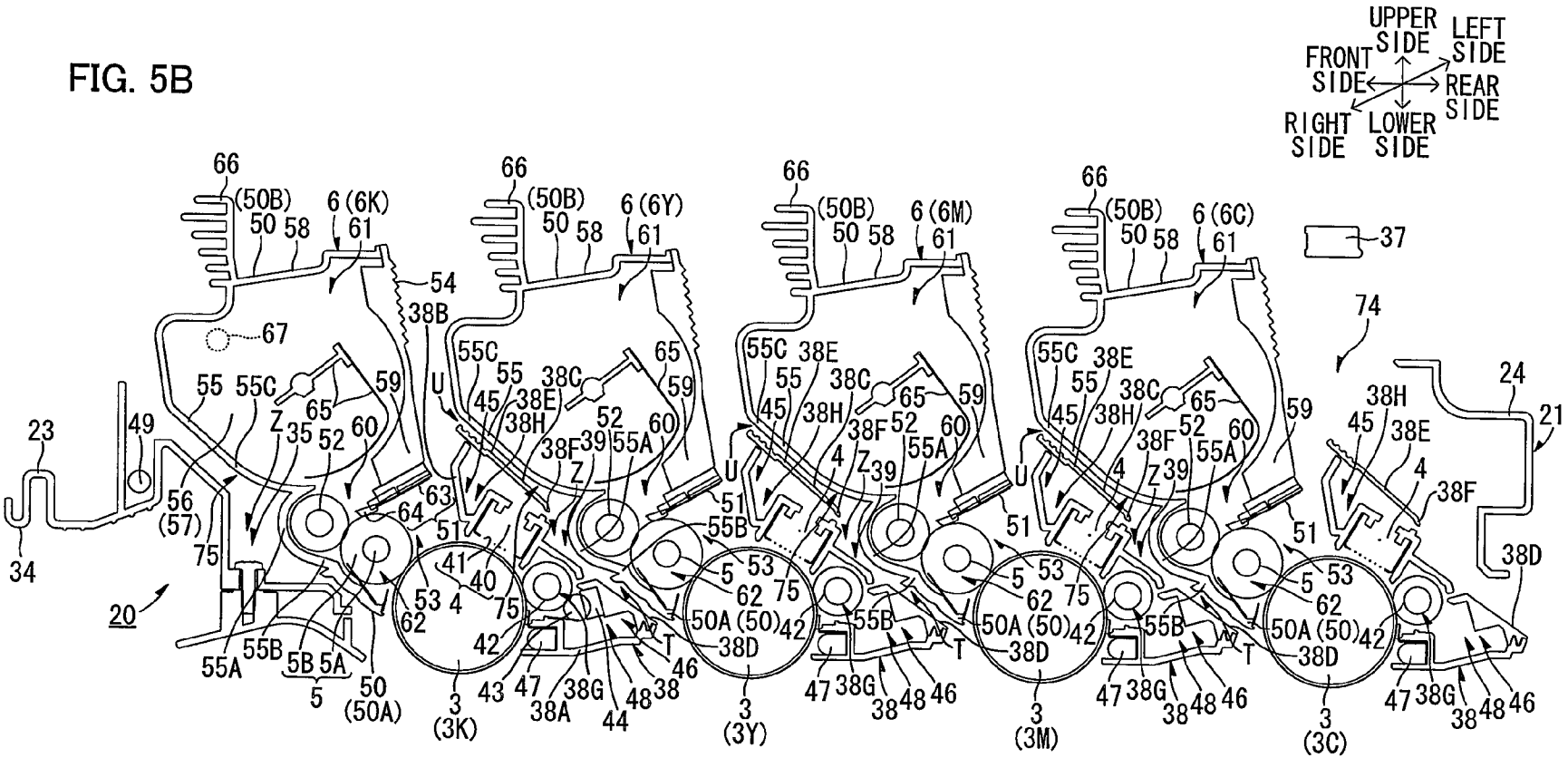
FIG. 5B shows a state where all developer cartridges are in the first attitude in FIG. 5A.

Referring again to the frontmost beam member 38 in FIG. 5B, the charger 4 is held by the second portion 38H. The charger 4 includes a discharge wire 40 arranged in the second portion 38H to be opposed to the corresponding photosensitive drum 3 (adjacent to the beam member 38 from the front side) at an interval and a grid 41 provided between the discharge wire 40 and the photosensitive drum 3 for controlling the quantity of charges from the discharge wire 40 to the photosensitive drum 3. The grid 41 is generally in the form of a U having an opened rear upper side as viewed from the width direction, and the discharge wire 40 extends along the width direction on the inner side of the grid 41. The grid 41 is exposed from the front wall 38B of the beam member 38 toward the photosensitive drum 3.

In image formation, the charger 4 uniformly charges the surface of the photosensitive drum 3 as hereinabove described, by applying a bias to the grid 41 while simultaneously applying a high voltage to the discharge wire 40 thereby corona-discharging the discharge wire 40. In the second portion 38H, a prescribed space (referred to as a fluid path 45) is partitioned above the charger 4. The fluid path 45 passes through the second portion 38H in the width direction, and communicates with an outer portion of the drawer unit 21 and the charger 4 (at least the discharge wire 40) respectively. Therefore, the fluid path 45 feeds air on the outer portion of the drawer unit 21, to pass through the charger 4.

The cleaning unit 48 is arranged in the first portion 38G. The cleaning unit 48 includes a cleaning roller 42, a sub roller 43 and a scraping member 44. The cleaning roller 42 constitutes an example of a cleaning member. The cleaning roller 42 is rotatably supported (held) by the first portion 38G in a state opposed to the photosensitive drum 3 on the front wall 38B of the beam member 38 to be in contact with the surface of the photosensitive drum 3 from the rear. The sub roller 43 is rotatably supported by the first portion 38G in a state coming into contact with the cleaning roller 42 from the rear lower side. The scraping member 44 is in the form of a sponge, for example, protrudes frontward in a state supported by the first portion 38G, and comes into contact with the rear peripheral surface of the sub roller 43 from the rear. In the first portion 38G, a prescribed space (referred to as a collecting chamber 46) is partitioned under the sub roller 43 and the scraping member 44.

In the cleaning unit 48, a primary bias is applied to the cleaning roller 42 from a bias source (not shown) provided in the main body casing 2 (see FIG. 1) while a secondary bias is applied to the sub roller 43 from the bias source (not shown) in image formation.

In the process of transferring the toner image from the aforementioned photosensitive drum 3 to the sheet S (see FIG. 1), sheet dust may adhere from the sheet S to the photosensitive drum 3. After the toner image is transferred to the sheet S, further, the excess toner may remain on the photosensitive drum 3. In foreign matter such as the sheet dust and the excess toner on the photosensitive drum 3, the excess toner is transferred to the surface of the cleaning roller 42 by the aforementioned primary bias, and captured by the cleaning roller 42. In the foreign matter on the surface of the photosensitive drum 3, the sheet dust is transferred to the cleaning roller 42 by the primary bias, thereafter transferred to the surface of the sub roller 43 by the secondary bias (more specifically, the difference between the primary and secondary biases) and collected by the sub roller 43 at timing other than that in the image formation. In other words, the sub roller 43 selects the sheet dust from the foreign matter captured by the cleaning roller 42 and collects the same. The sheet dust collected by the sub roller 43 is scraped by the scraping member 44, and thereafter stored in the collecting chamber 46.

When the image formation is ended, a bias reverse to the primary bias is applied to the cleaning roller 42, and the excess toner captured by the cleaning roller 42 is ejected from the cleaning roller 42 to the photosensitive drum 3, and thereafter collected by the developing roller 5. In other words, the printer 1 is the so-called cleanerless-type printer in which the excess toner (a waste toner) on the photosensitive drum 3 is collected by the developer roller 5 and not collected by a component (the cleaning unit 48) other than the developer roller 5.

Referring to the three beam members 38 on the rear side, the sub rollers 43 and the scraping members 44 may be omitted in the cleaning unit 48.

Each beam member 38 holds an electrical eliminating member 47 under the cleaning roller 42. The electrical eliminating member 47 exposes the overall region of the surface of the photosensitive drum 3 after transferring the toner image, and eliminates charges remaining on the surface of the photosensitive drum 3.

(1-2) Developer Cartridge

Each developer cartridge 6 is now described continuously with reference to FIG. 5B. The developer cartridge 6 is described with reference to a state (see FIGS. 1 and 5B) where the developer cartridge 6 is completely mounted to the main body casing 2 and the drawer unit 21. The attitude of the developer cartridge 6 in this state is referred to as a first attitude. At this time, the developer roller 5 is in contact with the corresponding photosensitive drum 3 in the developer cartridge 6, and this position of the developer cartridge 6 is referred to as a contacting position.

The four developer cartridges 6 are identical in structure to one another except for the colors of the toners accommodated therein, and hence each developer cartridge 6 is described with reference to the developer cartridge 6K positioned on the frontmost side in FIG. 5B.

The developer cartridge 6 mainly includes the aforementioned developer roller 5, a layer-thickness regulating blade 51 and a feed roller 52 in a developer casing 50 as an example of a casing forming the outline thereof.

The developer casing 50 is in the form of a box longitudinal in the width direction, having an opening 53 formed on the lower end thereof. The developer casing 50 includes a rear wall 54, a front wall 55, left and right walls 56 and 57 opposed to each other at an interval in the width direction, and a top wall 58 (see also FIG. 2).

The rear wall 54 generally vertically extends (more strictly, is slightly inclined frontward), while the front wall 55 extends toward the rear lower side (more specifically, a direction along the second slant direction Y shown in FIG. 4). In other words, the anteroposterior interval between the rear wall 54 and the front wall 55 is narrowed downward. The lower end edge of the front wall 55 extends along the width direction.

The left wall 56 is extended between the left end of the rear wall 54 and that of the front wall 55. The right wall 57 is extended between the right end of the rear wall 54 and that of the front wall 55. The anteroposterior interval between the rear wall 54 and the front wall 55 is narrowed downward as hereinabove described, and hence each of the left and right walls 56 and 57 is generally in the form of a triangle narrowed downward.

Bosses 67 protruding outward in the width direction are provided on the outer side surfaces of the left and right walls 56 and 57 in the width direction respectively (see also FIGS. 2 and 3: FIG. 2 shows the boss 67 of the right wall 57). The bosses 67 function as examples of pressed portions, and are provided on front upper end portions of the left and right walls 56 and 57. Thus, the bosses 67 are provided on both sides of each developer cartridge 6 in the width direction (see FIG. 3).

The top wall 58 blocks a portion surrounded by the upper ends of the rear wall 54, the front wall 55, the left wall 56 and the right wall 57 from above. Abutted portions 66 are integrally provided on both ends of a front region of the top wall 58 in the width direction. In other words, the abutted portions 66 are provided on both end portions of the developer cartridge 6 in the width direction (the orthogonal direction to the anteroposterior direction). In each developer cartridge 6, the abutted portions 66 provided on both end portions of the developer cartridge 6 in the width direction are arranged on a straight line L along the width direction (see FIG. 3).

Referring to the right abutted portion 66 in FIG. 2, each abutted portion 66 integrally includes two ribs 66A opposed to each other at a prescribed interval in the width direction and an extended member 66B extended between the upper ends of the two ribs 66A. Each rib 66A is generally in the form of a triangle narrowed upward as viewed from the width direction. The contour of each rib 66A as viewed from the width direction is partitioned by a rear edge 66C extending toward the front upper side and then slightly extending generally vertically upward, an upper edge 66D extending frontward from the upper end of the rear edge 66C and a front edge 66E extending from the front end of the upper edge 66D toward the front lower side and thereafter slightly extending generally vertically downward. The extended member 66B is planar in a generally horizontal direction, and extended between the upper edges 66D of the two ribs 66A.

A grip 68 is integrally provided on the center (a region held between the left and right abutted portions 66) of the top wall 58 in the width direction.

Referring to FIG. 5B, the lower end edge of the rear wall 54 extends along the width direction, and is positioned above the lower ends of the front wall 55, the left wall 56 and the right wall 57. The aforementioned opening 53 is partitioned by the lower end edge of the rear wall 54, the lower end edge of the front wall 55, the lower end portion of the left wall 56 and the lower end portion of the right wall 57, and generally in the form of a rectangle longitudinal in the width direction in rear elevational view.

In the developer casing 50, a partition wall 59 continuously extending from the lower end of the rear wall 54 frontward (toward the front wall 55) is provided slightly above the lower end portion of the developer casing 50. A prescribed clearance (referred to as a communication port 60) is formed between the front end of the partition wall 59 and the front wall 55. In the developer casing 50, a region located above the partition wall 59 defines a toner accommodation chamber 61, while a region located under the partition wall 59 defines a developing chamber 62 communicating with the opening 53. In other words, the partition wall 59 partitions the developer casing 50 into the toner accommodation chamber 61 and the developing chamber 62. The toner accommodation chamber 61 and the developing chamber 62 communicate with each other through the communication port 60.

In the developer casing 50, a portion partitioning the developing chamber 62 is referred to as a first casing portion 50A, and a portion partitioning the toner accommodation chamber 61 is referred to as a second casing portion 50B. The first casing portion 50A is the lower portion of the developer casing 50, while the second casing portion 50B is the upper portion of the developer casing 50.

The developer roller 5 is longitudinal in the width direction. In other words, the axis of the developer roller 5 extends along the width direction. The developer roller 5 includes a developer roller shaft 5A made of metal, for example, extending in the width direction, and a cylindrical rubber roller 5B covering the developer roller shaft 5A except both end portions in the width direction. The circle centers of the developer roller shaft 5A and the rubber roller 5B coincide with the axis of the developer roller 5. Both end portions of the developer roller shaft 5A in the width direction protrude outward from the developer casing 50 (the left wall 56 and the right wall 57) in the width direction. The developer roller 5 is stored in the developing chamber 62 (in other words, held by the first casing portion 50A), and rotatably supported by the developer casing 50 (the left wall 56 and the right wall 57). The axis of the developer roller 5 and the rotation axis of the developer roller 5 coincide with each other. The developer roller 5 is exposed toward the rear lower side in the opening 53.

The layer-thickness regulating blade 51 includes a leaf spring member 63 in the form of a thin plate longitudinal in the width direction and a pressure rubber 64 provided on the front end portion of the leaf spring member 63. The leaf spring member 63 is opposed to the aforementioned partition wall 59 from the rear lower side, while the pressure rubber 64 is in pressure contact with the outer peripheral surface of the developer roller 5 (the rubber roller 5B) from above due to the elastic force of the leaf spring member 63.

The feed roller 52 is longitudinal in the width direction, similarly to the developer roller 52. The feed roller 52 is arranged (more specifically, held by the first casing portion 50A) in the vicinity of the boundary between the toner accommodation chamber 61 and the developing chamber 62 (more strictly, under the communication port 60), and rotatably supported by the developer casing 50, similarly to the developer roller 5. The axis of the feed roller 52 and the rotation axis of the feed roller 52 coincide with each other. In this state, the feed roller 52 is opposed to and in contact with the developer roller 5 from the front upper side. In the front wall 55, a vertically intermediate portion coinciding with the feed roller 52 swells out frontward (toward the outer side of the developer casing 50) to be generally along the front outer peripheral surface of the feed roller 52, and is referred to as a first bump portion 55A.

A space surrounded by the partition wall 59, the front wall 55 (more specifically, the first bump portion 55A and a portion under the first bump portion 55A), the lower end portion of the left wall 56 and the lower end portion of the right wall 57 is the aforementioned developing chamber 62.

The toner to be fed to the developer roller 5 is accommodated in the toner accommodation chamber 61 (in the inner portion of the second casing portion 50B). A nonmagnetic one-component polymer toner, for example, is employed as the toner. The polymer toner is generally spherical, and has excellent fluidity. Further, an agitator 65 is provided in the toner accommodation chamber 61. The agitator 65 is rotatable in the toner accommodation chamber 61 around a rotation shaft extending in the width direction.

In the front wall 55, a lower portion corresponding to the first casing portion 50A defines a lower front wall 55B as an example of a first wall, and is opposed to the developer roller 5 and the feed roller 52 from the front lower side. On the other hand, an upper portion corresponding to the second casing portion 50B in the front wall 55 defines an upper front wall 55C as an example of a second wall, and is adjacent to the lower front wall 55B from above through the aforementioned first bump portion 55A. The lower front wall 55B and the upper front wall 55C are generally parallel to each other, and extend toward the rear lower side together (more specifically, in the second slant direction Y shown in FIG. 4). However, the first bump portion 55A swells out frontward (toward the outer side of the developer casing 50) as hereinabove described, the lower front wall 55B is continuous to the front end of the first bump portion 55A from below while the upper front wall 55C is continuous to the rear end of the first bump portion 55A from above, and hence the upper front wall 55C is located on a position deviating rearward (toward the inner side of the developer casing 50) as compared with the lower front wall 55B. Therefore, a recess 75 concaved toward the rear upper side is formed on an upper portion of the front wall 55 by the upper front wall 55C.

When each developer cartridge 6 is completely mounted to the drawer unit 21 in the first attitude and on the contacting position as shown in FIG. 5B, the developer cartridge 6 is arranged between the anteroposteriorly adjacent beam members 38 (the frontmost developer cartridge 6K is arranged between the front beam 23 and the frontmost beam member 38).

The front wall 55 (the lower front wall 55B and the upper front wall 55C) of each developer cartridge 6 is generally parallel to a reference plane (i.e., a plane extending along the second slant direction Y as viewed from the width direction) connecting the first portions 27A (see FIG. 4) of the pair of guide grooves 27 located on the same position (opposed to each other in the width direction) in the anteroposterior direction.

When the developer cartridge 6 (adjacent to each beam member 38 from the rear side) corresponding to each of the rear three developer cartridges 6 (6Y, 6M and 6C) is mounted to the drawer unit 21, the lower rear wall 38D is opposed to the lower front wall 55B of the developer cartridge 6 from the front lower side at a predetermined interval T and the upper rear wall 38E is opposed to the upper front wall 55C of the developer cartridge 6 from the front lower side at a predetermined interval U in each of the front three beam members 38. The predetermined intervals T and U are generally identical to each other, and extremely small. The upper rear wall 38E, protruding (deviating) toward the rear upper side beyond the lower rear wall 38D as hereinabove described, protrudes toward the corresponding developer cartridge 6 beyond the lower rear wall 38D.

More specifically, in the beam member 38 and the developer cartridge 6 adjacent to each other, the lower front wall 55B and the first bump portion 55A of the developer cartridge 6 fit into the recess 39 of the beam member 38 from the rear upper side, while the upper rear wall 38E and the second bump portion 38F of the beam member 38 fit into the recess 75 of the front wall 55 of the developer cartridge 6 from the front lower side. In this state, the first bump portion 55A is positioned on the rear lower side of the second bump portion 38F, and a slit Z is ensured between the first bump portion 55A and the second bump portion 38F in the extensional direction (the second slant direction Y shown in FIG. 4) of the first portion 27A of the guide groove 27.

In the frontmost developer cartridge 6K, the front wall 55 is generally along the rear surface of the front beam 23 with a small clearance, and the first bump portion 55A of the front wall 55 fits into the recess 35 on the rear surface of the front beam 23 from the rear upper side.

In each of the four developer cartridges 6, the developer roller 5 is opposed to the photosensitive drum 3 from the front upper side, and in contact therewith as hereinabove described. In this state, each developer cartridge 6 in the first attitude is entirely slightly inclined frontward. At this time, the rollers 36 (see FIGS. 2 and 3) of the corresponding beam member 38 or the front beam 23 are in contact with the front wall 55 (more specifically, the upper front wall 55C located above the first bump portion 55A) of each developer cartridge 6 from the front lower side, thereby maintaining the first attitude (the inclined state) of the developer cartridge 6. Thus, each developer cartridge 6 leans against the corresponding beam member 38 (adjacent to the developer cartridge 6 from the front side) or the front beam 23 from the rear side.

The aforementioned image formation can be executed when each developer cartridge 6 is in the first attitude and on the contact position as shown in FIG. 5B. In the image formation, the toner in the toner accommodation chamber 61 is agitated following rotation of the agitator 65 and drops into the developing chamber 62 from the communication port 60 to be fed to the feed roller 52 in each developer cartridge 6. Thereafter the toner is fed to the developer roller 5 following rotation of the feed roller 52. The toner fed to the developer roller 5 enters the position between the pressure rubber 64 of the layer-thickness regulating blade 51 and the outer peripheral surface of the developer roller 5 (the rubber roller 5B), and is carried on the outer peripheral surface as a thin layer as hereinabove described, while the thickness thereof is regulated between the pressure rubber 64 and the outer peripheral surface of the developer roller 5.

(2) Attachment and Detachment of Developer Cartridge to and from Drawer Unit

In order to mount each developer cartridge 6 to the drawer unit 21, referring to FIG. 2, the grip 68 is first grasped to move the developer cartridge 6, for arranging the developer cartridge 6 on a position coinciding with the corresponding photosensitive drum 3 in the anteroposterior direction above the drawer unit 21.

Then, the developer cartridge 6 is moved down, and inserted into the drawer unit 21 from the opening 74. As the developer cartridge 6 is inserted into the drawer unit 21, both end portions of the developer roller shaft 5A (see the frontmost developer cartridge 6 in FIG. 5B) protruding outward from the developer casing 50 (the left wall 56 and the right wall 57) in the width direction are fitted into the second portions 27B of the corresponding guide grooves 27 in the side plates 22 of the drawer unit 21. In other words, the left end portion of the developer roller shaft 5A is fitted from above into the second portion 27B of the second guide groove 27 of the left side plate 22 from the rear while the right end portion of the developer roller shaft 5A is fitted from above into the second portion 27B of the second guide groove 27 of the right side plate 22 from the rear, in the second developer cartridge 6M from the rear in FIG. 2.

Thus, referring to FIG. 4, both end portions of the developer roller shaft 5A in the width direction are guided by the second portions 27B of the guide grooves 27, whereby the developer cartridge 6 is inserted into the drawer unit 21 while generally linearly moving slightly toward the rear lower side along the extensional direction (on the downstream side of the first slant direction X slightly directed toward the rear lower side) of the second portions 27B. In other words, the first slant direction X is along the mounting direction of the developer cartridge 6 to the drawer unit 21.

When the developer cartridge 6 is continuously inserted into the drawer unit 21 after both end portions of the developer roller shaft 5A in the width direction reach the lower end portions of the second portions 27B of the guide grooves 27, both end portions of the developer roller shaft 5A in the width direction are guided by the first portions 27A of the corresponding guide grooves 27 in the developer cartridge 6, and thereafter reach the deepest portions of the guide grooves 27 (the first portions 27A), due to the own weight of the developer cartridge 6.

At this time, each of the left and right bosses 67 (see the boss 67 shown by the dotted line in FIG. 4) shown in FIG. 4 comes into contact with the pressing cam 32 (see the pressing cam 32 shown by the dotted line) and the detaching cam 33 (see the detaching cam 33 on the same position as the pressing cam 32 shown by the dotted line) both in the standby attitude from above. When both of the pressing cam 32 and the detaching cam 33 are on standby attitude, the lower end portion of the curved surface portion 32B of the pressing cam 32 is opposed to the front side surface of the detaching portion 33D of the detaching cam 33 from the front side at a small interval, as hereinabove described. Therefore, each boss 67 coming into contact with the pressing cam 32 and the detaching cam 33 both in the standby attitude from above cannot further move down. At this time, each boss 67 is positioned above the pressing surface 32D of the corresponding pressing cam 32. Further, the developer roller 5 comes into contact with the corresponding photosensitive drum 3 in a state directed toward a rotational center (a circle center) 3A of the photosensitive drum 3 from the front upper side along the second slant direction Y.

Thus, the overall developer cartridge 6 cannot further move down (cannot linearly move toward the rear lower side). The current attitude of the developer cartridge 6 is referred to as a second attitude (see also the second developer cartridge 6M from the rear in FIG. 5A).

At this time (when the developer cartridge 6 is in the second attitude), the developer roller 5 comes into contact with the photosensitive drum 3 from the front upper side while both end portions of the developer roller shaft 5A in the width direction reach the deepest portions of the guide grooves 27 (the first grooves 27A) (more specifically, both end portions of the developer roller shaft 5A in the width direction fit into the space between the opposing surfaces 28C of the corresponding pair of guide ribs 28), as hereinabove described. Thus, the developer roller 5 is positioned. It is understood that the guide grooves 27 guide the developer roller 5 of the developer cartridge 6 mounted to the drawer unit 21 toward the corresponding photosensitive drum 3.

When the first and second portions 27A and 27B of each guide groove 27 are defined with reference to the mounting direction (the rear lower side) of the developer cartridge 6 to the drawer unit 21, the first portion 27A extends along the second slant direction Y toward the rotational center 3A as directed toward the downstream side of the mounting direction on a downstream-side end portion of the guide groove 27 in the mounting direction. The second portion 27B is continuously directed from the opening 74 toward the downstream side in the mounting direction on the upstream side of the guide groove 27 in the mounting direction, and extends in a direction (the first slant direction X) intersecting with the first portion 27A.

Referring to the second developer cartridge 6M from the rear in FIG. 5A, the rear wall 54 is along the vertical direction and the developer cartridge 6 is upright as a whole when the developer cartridge 6 is in the second attitude, as compared with the case where the same is in the first attitude (see each developer cartridge 6 other than the developer cartridge 6M in FIG. 5A). At this time, the developer cartridge 6 (more specifically, around the rear wall 54) in the second attitude is on a position interfering with a passage region (see broken arrow in FIG. 1) of the laser beam from the scanner unit 7 to the photosensitive drum 3 (the photosensitive drum 3M in the case of the developer cartridge 6M) corresponding to the developer cartridge 6.

In the developer cartridge 6 taking the second attitude, the front wall 55 separates toward the rear upper side from the rear wall 38C of the beam member 38 adjacent to the developer cartridge 6 from the front side while the front bump portion 55A and the lower front wall 55B are disengaged from the recess 39 of the rear wall 38C toward the rear upper side, as compared with the case where the developer cartridge 6 takes the first attitude. When the developer cartridge 6K (the frontmost developer cartridge 6) is in the second attitude (this state is not shown), the front wall 55 separates from the rear surface of the front beam 23 toward the rear upper side and the first bump portion 55A is disengaged from the recess 35 on the rear surface of the front beam 23 toward the rear upper side as compared with the case where the developer cartridge 6K is in the first attitude. Before the developer cartridge 6 takes the second attitude after the operation of inserting the same into the drawer unit 21 is started, the developer cartridge 6 (particularly the front wall 55) does not come into contact with the beam member 38 adjacent to the developer cartridge 6 from the front side or the front beam 23.

When the grip 68 (see FIG. 2) is grasped and twisted frontward while the developer cartridge 6 is in the second attitude (see the developer cartridge 6M in FIG. 5A), the developer cartridge 6 pivots (is inclined) frontward on the positioned developer roller 5 (reaching the first portion 27A of the guide groove 27 shown in FIG. 4). Thus, the developer cartridge 6 shifts from the second attitude to the first attitude (see the developer cartridge 6M in FIG. 5B).

When the developer cartridge 6 is in the first attitude (see each developer cartridge 6 other than the developer cartridge 6M in FIG. 5A), the lower rear wall 38D is opposed to the lower front wall 55B of the developer cartridge 6 at the predetermined interval T and the upper rear wall 38E is opposed to the upper front wall 55C of the developer cartridge 6 at the predetermined interval U in the corresponding beam member 38 (adjacent to the developer cartridge 6 from the front side), as hereinabove described. The developer cartridge 6 in the first attitude is on the position not interfering with the aforementioned passage region (see the broken arrow in FIG. 1) of the laser beam (see FIG. 1).

The state of the developer cartridge 6 shifting from the second attitude to the first attitude is further described with reference to FIG. 4. Referring to the front pressing cam 32 in FIG. 4, each of the left and right bosses 67 (see the boss 67 shown by the dotted line in FIG. 4) comes into contact with the pressing cam 32 (see the pressing cam 32 shown by the dotted line) and the detaching cam 33 both in the standby attitude from above, as hereinabove described. The lower end portion of the curved surface portion 32B of the pressing cam 32 is opposed to the front side surface of the detaching portion 33D of the detaching cam 33 from the front side at a small interval. Each boss 67 is in contact with the lower portion of the curved surface portion 32B of the pressing cam 32 in the standby attitude from the rear side, and in contact with the front upper end portion notched in the detaching portion 33D of the detaching cam 33 in the standby attitude from the upper side.

When the developer cartridge 6 pivots frontward on the positioned developer roller 5 in order to shift to the first attitude in this state as hereinabove described, each boss 67 pivots toward the front lower side on the developer roller 5, and presses the lower end portion of the curved surface portion 32B of the pressing cam 32 (see the pressing cam 32 shown by the dotted line) in the standby attitude. Thus, the pressing cam 32 in the standby attitude pivots toward the front upper side against the urging force of the aforementioned urging member (not shown) urging the pressing cam 32 in the direction for shifting from the pressing attitude to the standby attitude, and shifts to the pressing attitude (see the pressing cam 32 shown by the solid line).

The contacting position of the boss 67 and the pressing cam 32 (the curved surface portion 32B) is so set that the pivot shaft 32C of the pressing cam 32 is not present on a straight line passing through the direction of the boss 67 (see the boss 67 shown by the dotted line) pressing the pressing cam 32 when the developer cartridge 6 is in the second attitude. Therefore, the pressing cam 32 is pressed by the boss 67 to smoothly pivot toward the front upper side.

The pressing cam 32 so shifts from the standby attitude (see the pressing cam 32 shown by the dotted line) to the pressing attitude (see the pressing cam 32 shown by the solid line) that the pressing cam 32 (more specifically, the curved surface portion 32B) separates from the detaching cam 32 (more specifically, the front side surface of the detaching portion 33D) toward the front upper side. Thus, each boss 67 enters the space between the pressing cam 32 and the detaching portion 33D of the detaching cam 33 while continuously pivoting toward the front lower side (see the boss 67 shown by the solid line in FIG. 4). Thus, the developer cartridge 6 shifts from the second attitude (see the developer cartridge 6M in FIG. 5A) to the first attitude (see the developer cartridge 6M in FIG. 5B).

Noting the pressing cam 32, the pressing cam 32 is first in contact with the boss 67 from the front side (see the pressing cam 32 and the boss 67 shown by the dotted lines in FIG. 4) and thereafter moves toward the front upper side while keeping the contacting state (see the pressing cam 32 and the boss 67 shown by the solid lines in FIG. 4) when the developer cartridge 6 shifts from the second attitude to the first attitude. While the developer cartridge 6 shifts from the second attitude to the first attitude, therefore, the pressing cam 32 does not press the boss 67 (i.e., the developer cartridge 6) at least upward, and hence the developer cartridge 6 does not abruptly float up.

When the developer cartridge 6 is in the first attitude, each boss 67 is located under the pressing surface 32D of the pressing cam 32 as shown by the solid line, and anteroposteriorly (vertically) held between the pressing surface 32D and the front side surface of the detaching portion 33D of the detaching cam 33. Each boss 67 is located above the pressing surface 32D of the corresponding pressing cam 32 (see the boss 67 shown by the dotted line) when the developer cartridge 6 is in the second attitude as hereinabove described, and hence each boss 67 moves downward from the position above the corresponding pressing surface 32D when the developer cartridge 6 shifts from the second attitude to the first attitude.

When the developer cartridge 6 is in the first attitude, the pressing cam 32 (see the front pressing cam 32 shown by the solid line) is regularly urged by the aforementioned urging member (not shown) in the direction (the direction pivoting toward the rear lower side) for returning to the standby attitude (see the pressing cam 32 shown by the dotted line). Therefore, each boss 67 is positioned under the pressing surface 32D of the pressing cam 32 and engaged with the pressing surface 32D, to be pressed by the pressing surface 32D toward the rear lower side (the front side surface of the detaching portion 33D of the detaching cam 33). In other words, the pressing surface 32D presses the boss 67 when the corresponding boss 67 is positioned under the pressing surface 32D.

The force (toward the rear lower side) of the pressing surface 32D of the pressing cam 32 pressing each boss 67 is resultant force of the force acting in the aforementioned second slant direction Y (toward the rear lower side) and the force preventing the developing cartridge 6 from floating up. When the pressing surface 32D of the pressing cam 32 presses each boss 67, therefore, the overall developer cartridge 6 (see FIG. 2) including the boss 67 is pressed toward the downstream side (the rear lower side) in the second slant direction Y (the extensional direction of the first portion 27A of the guide groove 27). Following this, the developer roller 5 comes into pressure contact with the corresponding photosensitive drum 3 from the front upper side toward the rotational center 3A of the photosensitive drum 3 in the state guided by the first portion 27A of the guide groove 27 (see FIG. 5B).

In other words, the pressing surface 32D presses the developer cartridge 6 to direct the developer roller 5 toward the corresponding photosensitive drum 3 when the developer cartridge 6 is in the first attitude. In this state, the developer cartridge 6 is completely mounted to the drawer unit 21 (see each developer cartridge 6 shown in FIG. 5B).

When all developer cartridges 6 shift from the second attitude to the first attitude through the aforementioned procedure, all developer cartridges 6 are completely mounted to the drawer unit 21, to complete the process unit 20 (see FIG. 5B).

As shown in FIG. 2, it is understood that the pressing cams 32 (more specifically, the pressing surfaces 32D) are provided on positions coinciding with both sides of the corresponding developer cartridge 6 mounted to the drawer unit 21 in the width direction.

Each developer cartridge 6 may be detached from the drawer unit 21 through a procedure reverse to that for mounting the developer cartridge 6 to the drawer unit 21. In other words, the grip 68 is first grasped and twisted rearward. Thus, the overall developer cartridge 6 pivots (is inclined) rearward on the developer roller 5, as understood from the developer cartridge 6M shown in FIG. 5A. Thus, the developer cartridge 6 shifts from the first attitude to the second attitude. When the developer cartridge 6 is in the second attitude (see the developer cartridge 6M shown in FIG. 5A), referring to FIG. 4, each boss 67 is located above the pressing surface 32D of the corresponding pressing cam 32 (see the pressing cam 32 shown by the dotted line) and disengaged from the pressing surface 32D as hereinabove described, to be released from the pressing surface 32D (see the boss 67 shown by the dotted line). In other words, the developer cartridge 6 in the second attitude is released from the pressing surface 32D and no force acts to press the developer cartridge 6 toward the downstream side (the rear lower side) in the second slant direction Y, whereby the developer cartridge 6 in the second attitude is upwardly movable, and detachable from the drawer unit 21.

When the grip 68 (see FIG. 2) is pulled up in the state where the developer cartridge 6 is in the second attitude thereby moving up the overall developer cartridge 6, both end portions of the developer roller shaft 5A separate upward from the corresponding guide grooves 27 and the overall developer cartridge 6 moves upward beyond the opening 74 of the drawer unit 21, the developer cartridge 6 is completely detached from the drawer unit 21.

As hereinabove described, referring to the developer cartridge 6M shown in FIGS. 5A and 5B, each developer cartridge 6 can shift between the first attitude (see FIG. 5B) and the second attitude (see FIG. 5A) in the drawer unit 21. Further, it is understood that the opening 74 of the drawer unit 21 passes each developer cartridge 6 detachably mounted to the drawer unit 21 therethrough.

(3) Attachment and Detachment of Process Unit to and from Main Body Casing

Attachment and detachment of the process unit 20 to and from the main body casing 2 are now described.

Referring to FIG. 1, the front wall of the main body casing 2 defines a cover 70. The cover 70 is pivotable on the lower end thereof. More specifically, the cover 70 pivots between an upright closing position shown in FIG. 1 and a frontwardly inclined opening position shown in FIGS. 6 and 7.

When the cover 70 is on the opening position, a mounting port 71 is formed on the front surface of the main body casing 2. The mounting port 71 has a size capable of anteroposteriorly passing the process unit 20 detachably mounted to the main body casing 2 therethrough, and communicates with a space (referred to as an accommodating space 72) accommodating the process unit 20 mounted to the main body casing 2 from the front side.

In the accommodating space 72, the upper end is partitioned by the scanner unit 7, while the lower end is partitioned by the transport belt 11. A positioning shaft 73 extending in the width direction to be extended between the left and right sidewalls of the main body casing 2 is provided on the rear end side of the accommodating space 72.

In the main body casing 2, an abutment portion 69 is provided on the upper end portion of the mounting port 71 (more specifically, the upper end portion of the front end of the accommodating space 72 in front of the scanner unit 7). The abutment portion 69 is in the form of a generally vertically extending plate longitudinal in the width direction, for example, and the lower end portion thereof is positioned slightly under the lower end of the scanner unit 7 in the vertical direction. When the cover 70 is on the opening position, the abutment portion 69 is exposed frontward from the mounting port 71.

Figure 6:
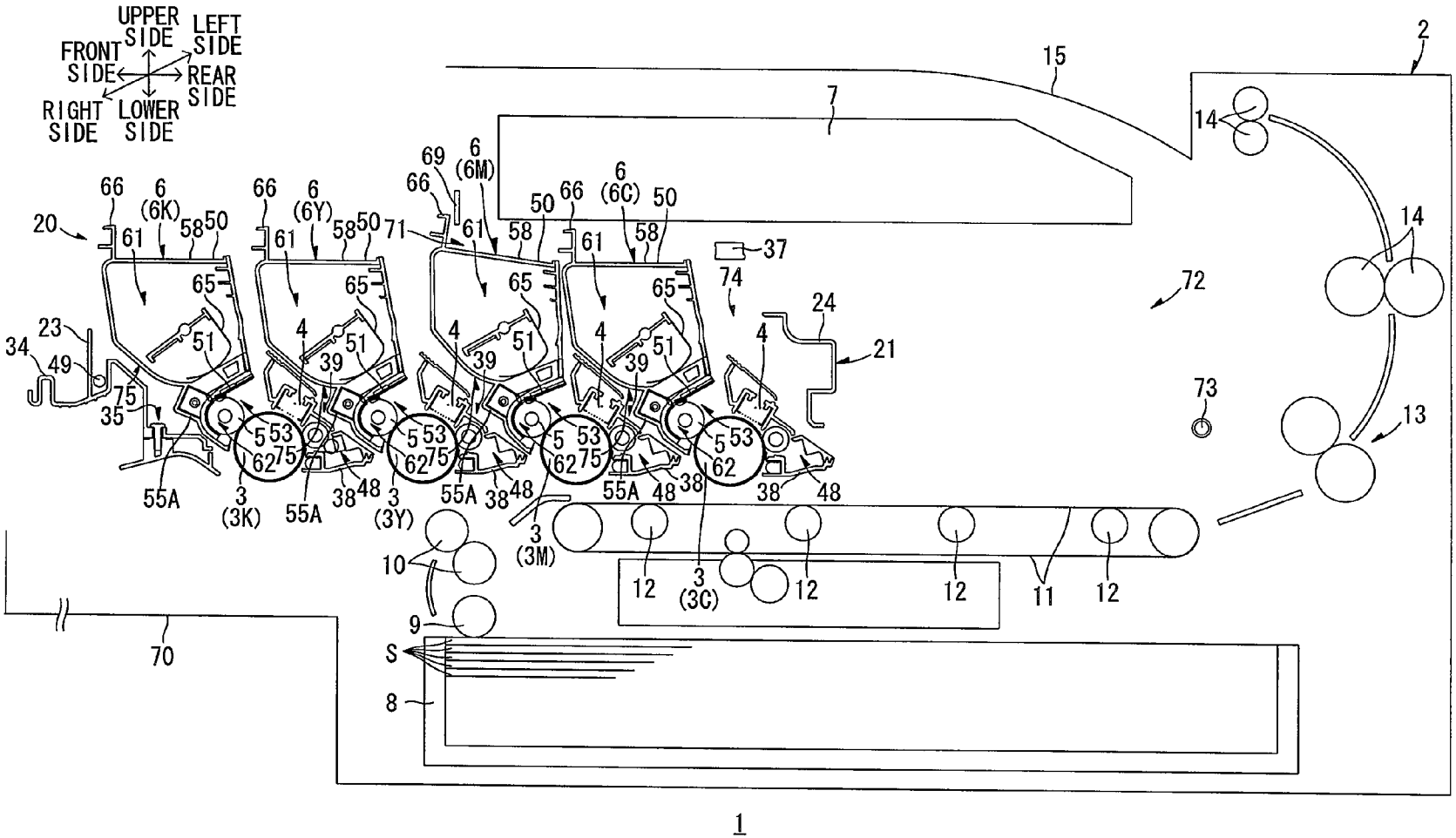
FIG. 6 is a right side sectional view of a printer, showing an intermediate state in the process of mounting the process unit shown in FIG. 5A to a main body casing.

In order to mount the process unit 20 to the main body casing 2, the cover 70 is first set to the opening position, to open the mounting port 71, as shown in FIG. 6.

Then, both of the front and rear handles 34 and 37 are grasped to arrange the process unit 20 in front of the mounting port 71, and the rear end of the process unit 20 is inserted into the mounting port 71 from the front side. At this time, the left and right guide rails 25 and the rollers 26 (see FIG. 2) of the drawer unit 21 are engaged with guide members (not shown) provided in the accommodating space 72 in the process unit 20. Thus, the process unit 20 is received in the mounting port 71 while each photosensitive drum 3 slightly separates upward from the transport belt 11 (while the process unit 20 itself is not in contact with the transport belt 11).

When the front handle 34 is grasped and the process unit 20 is pressed rearward in this state, the aforementioned guide rails 25 and the rollers 26 (see FIG. 2) are guided by the aforementioned guide members (not shown) provided in the accommodating space 72, whereby the process unit 20 is directed rearward along a generally horizontal direction while keeping the attitude not in contact with the transport belt 11, and inserted into the accommodating space 72.

When each developer cartridge 6 is in the first attitude as the rearmost developer cartridge 6C in the process unit 20, each abutted portion 66 on the upper end of the developer cartridge 6 (the developer cartridge 6C) is on a position lower than the abutment portion 69 on the upper end portion of the mounting port 71. As the process unit 20 is inserted into the accommodating space 72, therefore, the developer cartridge 6 in the first attitude passes through the mounting port 71 rearward without coming into contact with the abutment portion 69.

When each developer cartridge 6 is in the second attitude as the second developer cartridge 6M from the rear, however, the abutted portion 66 of the developer cartridge 6 coincides with the abutment portion 69 in the vertical direction (the height direction). When the developer cartridge 6 (the developer cartridge 6M) in the second attitude passes through the mounting port 71 rearward as the process unit 20 is inserted into the accommodating space 72, therefore, the abutted portion 66 (more specifically, the rear edge 66C of each rib 66A shown in FIG. 2) of the developer cartridge 6 is abutted by the abutment portion 69 from the rear.

Figure 7:
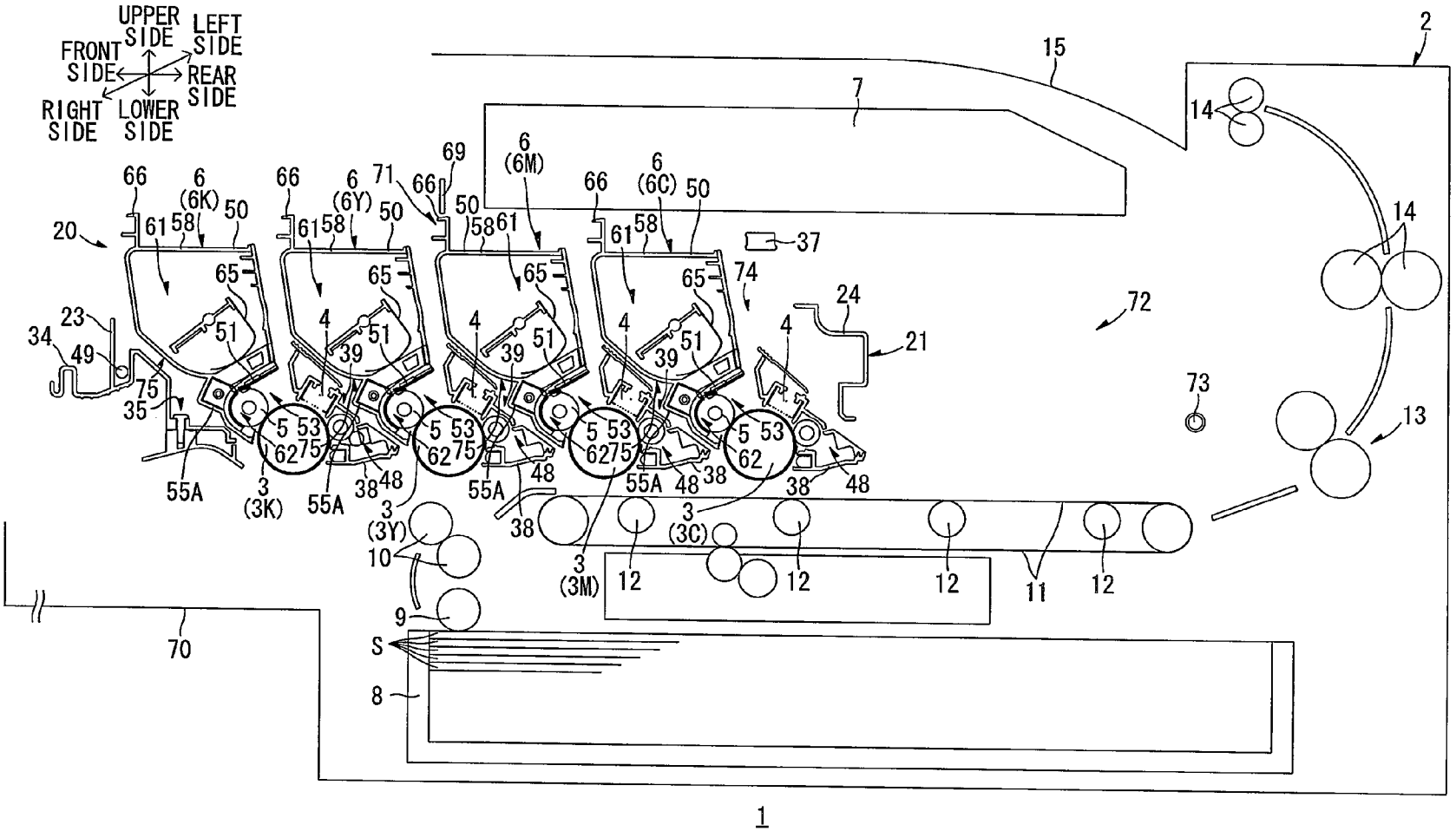
FIG. 7 is a right side sectional view of the printer, showing an intermediate state in the process of mounting the process unit shown in FIG. 5B to the main body casing.

Thus, the developer cartridge 6M in the second attitude pivots (is inclined) frontward, shifts to the first attitude as shown in FIG. 7, and thereafter passes through the mounting port 71 rearward without coming into contact with the abutment portion 69.

Thus, the abutment portion 69 of the main body casing 2 abuts the abutted portions 66 of the developer cartridge 6 in the second attitude when the process unit 20 is mounted to the main body casing 2, thereby changing the developer cartridge 6 from the second attitude to the first attitude.

The developer cartridge 6 (see the developer cartridge 6M in FIG. 6) in the second attitude is inclined toward the upstream side (the front side) in the mounting direction (toward the rear side) of the process unit 20 to the main body casing 2, thereby shifting from the second attitude to the first attitude (see the developer cartridge 6M in FIG. 7). With reference to the mounting direction of the process unit 20 to the main body casing 2, it is understood that each abutted portion 66 provided on the front region of the top wall 58 of the developer casing 50 is arranged on the upstream side in the mounting direction in each developer cartridge 6.

The abutted portion 66 may be urged upward by a spring (not shown) or the abutment portion 69 may be urged downward by a spring (not shown), so that the abutted portion 66 of the developer cartridge 6 (see the developer cartridge 6M in FIG. 6) in the second attitude coincides with the abutment portion 69 in the vertical direction. Thus, the abutted portion 66 of the developer cartridge 6 in the second attitude is necessarily abutted by the abutment portion 69.

When the process unit 20 is completely inserted into the accommodating space 72 as shown in FIG. 1, the aforementioned guide rails 25 and the rollers 26 (see FIG. 2) of the process unit 20 are disengaged from the aforementioned guide members (not shown) in the accommodating space 72. Thus, the process unit 20 moves down, and each photosensitive drum 3 comes into contact with the transport belt 11 from above.

Thereafter the cover 70 is moved to the closing position, whereby the process unit 20 is completely mounted to the main body casing 2. At this time, the positioning shaft 73 on the side of the main body casing 2 engages with the rear beam 24 of the drawer unit 21 of the process unit 20 from the rear, while the positioning shaft 49 on the side of the process unit 20 engages with the main body casing 2. Thus, the position of the process unit 20 mounted to the main body casing 2 is fixed.

In order to detach the process unit 20 mounted to the main body casing 2 from the main body casing 2, the cover 70 is moved to the opening position, and the front handle 34 is thereafter grasped to draw the process unit 20 frontward, as shown in FIG. 7. At this time, each abutted portion 66 of each developer cartridge 6 in the first attitude does not come into contact with the bottom surface of the scanner unit 7 and the abutment portion 69. In the process of drawing the process unit 20 frontward, therefore, the abutted portion 66 is not caught by the bottom surface of the scanner unit 7 and the abutment portion 69 to change the developer cartridge 6 from the first attitude to the second attitude (see the developer cartridge 6M in FIG. 6). When the process unit 20 is drawn until the same is entirely positioned in front of the mounting port 71, the process unit 20 is completely detached from the main body casing 2.

When the process unit 20 is mounted to the main body casing 2 as shown in FIG. 1, a coupling member (not shown) on the side of the main body casing 2 is inserted into each insertional opening 29 (see FIGS. 2 and 4) of the left side plate 22 of the drawer unit 21 of the process unit 20 and coupled to each developer cartridge 6. In this state, driving force generated by a motor (not shown) on the side of the main body casing 2 is transmitted to each developer cartridge 6 through the coupling member (not shown), whereby the developer roller 5, the feed roller 52 and the agitator 65 rotate in each developer cartridge 6 in the image formation.

(4) Others

When the process unit 20 is mounted to the main body casing 2 as shown in FIG. 1, all (four) developer cartridges 6 of the process unit 20 are in the first attitude and on the contacting position (see also FIG. 5B). Therefore, each boss 67 of each developer cartridge 6 is pressed by the pressing surface 32D of the pressing cam 32 (see the front pressing cam 32 shown by the solid line) in the pressing attitude to the rear lower side toward the front side surface of the detaching portion 33D of the detaching cam 33 on the standby position, as hereinabove described and as shown by the solid line in FIG. 4.

Thus, the overall developer cartridge 6 including the boss 67 is pressed toward the downstream side (the rear lower side) in the second slant direction Y, and the developer roller 5 is in pressure contact with the corresponding photosensitive drum 3 from the front upper side toward the rotational center 3A of the photosensitive drum 3 (see also FIG. 5B).

When the developer roller 5 is in pressure contact with the corresponding photosensitive drum 3 from the front upper side in all developer cartridges 6 (i.e., when all developer cartridges 6 are on the contacting position) as shown in FIG. 1, the electrostatic latent images of all photosensitive drums 3 are visualized, whereby the color image is formed on the sheet S, as hereinabove described.

The printer 1 can execute not only the mode (the color printing mode shown in FIG. 1) forming the color image but also a monochromatic printing mode (see FIG. 8) forming a monochromatic image.

In order to shift from the color printing mode to the monochromatic printing mode, referring to FIG. 4, the projection 33F of the detaching cam 33 opposed to each boss 67 of each developer cartridge 6Y, 6M or 6C (see FIG. 1) other than the developer cartridge 6K in the detaching portion 33D, is pressed by the main body casing 2 (see FIG. 1) from above, whereby the detaching cam 33 of each developer cartridge 6Y, 6M or 6C shifts from the standby attitude to the aforementioned detaching attitude (not shown). Thus, the detaching portion 33D deviates toward the front upper side (not shown), as hereinabove described.

As hereinabove described, the deviating direction (the direction toward the front upper side) of the detaching portion 33D is generally parallel to the second slant direction Y (see thick dotted arrow). Further, both end portions of the developer roller shaft 5A in the width direction fit into the space between the opposing surfaces 28C (the first portion 27A of the guide groove 27) of the pair of guide ribs 28 (the front and rear ribs 28A and 28B), and the opposing surfaces 28C (the first portion 27A) parallelly extend along the second slant direction Y.

Figure 8:
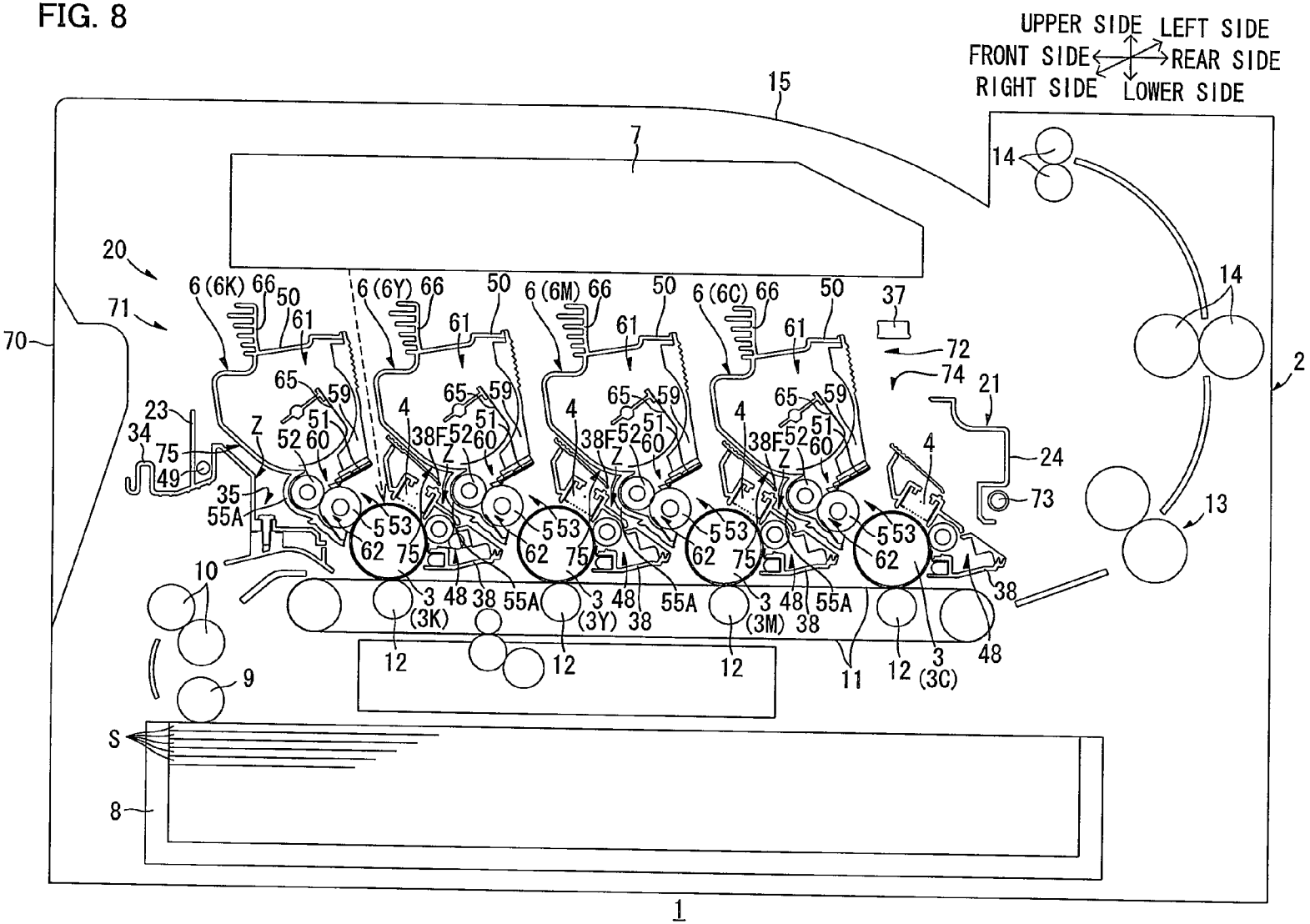
FIG. 8 is a right side sectional view of the printer in a monochromatic printing operation.

When the detaching cam 33 shifts from the standby attitude to the detaching attitude and the detaching portion 33D deviates toward the front upper side (the upstream side of the second slant direction Y), therefore, the boss 67 of each developer cartridge 6Y, 6M or 6C (see FIG. 8) is pressed by the corresponding detaching portion 33D toward the front upper side, whereby each developer cartridge 6Y, 6M or 6C entirely deviates from the contacting position toward the front upper side (the upstream side of the second slant direction Y). Consequently, the developer roller 5 of each developer cartridge 6Y, 6M or 6C detaches from the corresponding photosensitive drum 3 (3Y, 3M or 3C) toward the front upper side, as shown in FIG. 8. The position of the developer cartridge 6 on which the developer roller 5 detaches from the photosensitive drum 3 is referred to as a detaching position. When the detaching cam 33 (see FIG. 4) shifts from the detaching attitude to the standby attitude, the developer cartridge 6 on the detaching position can deviate toward the rear lower side (the downstream side of the second slant direction Y), to return to the contacting position (see FIG. 1).

In the black developer cartridge 6K, on the other hand, the developer roller 5 is continuously in pressure contact with the corresponding photosensitive drum 3K, so that the electrostatic latent image of the photosensitive drum 3K can be visualized. This state is the monochromatic printing mode, and only a black toner image (a monochromatic image) is formed on the sheet S.

The printer 1 can also execute a total detaching mode in which all developer cartridges 6 shift from the contacting position to the detaching position (the developer rollers 5 of all developer cartridges 6 detach from the corresponding photosensitive drums 3).

As hereinabove described, each developer cartridge 6 is movable by a prescribed distance between the contacting position (see all developer cartridges 6 shown in FIG. 1) and the detaching position (see the developer cartridges 6Y, 6M and 6C shown in FIG. 8) along the extensional direction (the second slant direction Y shown in FIG. 4) of the first portion 27A of the guide groove 27 in the state mounted to the drawer unit 21.

When the developer cartridge 6 is on the contacting position, the lower rear wall 38D is opposed to the lower front wall 55B of the developer cartridge 6 through the predetermined interval T and the upper rear wall 38E is opposed to the upper front wall 55C of the developer cartridge 6 through the predetermined interval U in the corresponding beam member 38 (adjacent to the developer cartridge 6 from the front side), as hereinabove described and as shown in FIG. 5B. As hereinabove described, the slit Z is ensured between the first bump portion 55A of the developer cartridge 6 and the second bump portion 38F of the beam member 38 in the extensional direction (the second slant direction Y shown in FIG. 4, extending in the front upper side and the rear lower side) of the first portion 27A of the guide groove 27.

Also when the developer cartridge 6 moves from the contacting position to the detaching position on the front upper side (see the developer cartridges 6Y, 6M and 6C shown in FIG. 8), the lower rear wall 38D is continuously opposed to the lower front wall 55B of the developer cartridge 6 through the predetermined interval T and the upper rear wall 38E is continuously opposed to the upper front wall 55C of the developer cartridge 6 through the predetermined interval U in the corresponding beam member 38. Further, the slit Z is ensured between the first bump portion 55A of the developer cartridge 6 and the second bump portion 38F of the beam member 38 in the extensional direction (the second slant direction Y shown in FIG. 4) of the first portion 27A of the guide groove 27 (see the developer cartridges 6Y, 6M and 6C shown in FIG. 8).

When the frontmost developer cartridge 6K is on the contacting position, the first bump portion 55A of the front wall 55 of the developer cartridge 6K fits into the recess 35 on the rear surface of the front beam 23 from the rear upper side, as hereinabove described. Also when the developer cartridge 6K moves from the contacting position to the detaching position on the front upper side (not shown), the first bump portion 55A of the front wall 55 of the developer cartridge 6K continuously fits into the recess 35 on the rear surface of the front beam 23 from the rear upper side, and the slit Z is ensured on the front upper side of the first bump portion 55A in the recess 55.

<3. Functions/Effects>

(1) As hereinabove described, the printer 1 includes the process unit 20 detachably mountable to the main body casing 2 along the prescribed direction (the anteroposterior direction) (see also FIGS. 6 and 7).

The process unit 20 includes the drawer unit 21, the plurality of photosensitive drums 3 supported by the drawer unit 21 in the state parallelly arranged in the anteroposterior direction, on which the electrostatic latent images are formed and the plurality of developer cartridges 6 including the developer roller 5 opposed to the corresponding photosensitive drum 3 and detachably mountable to the drawer unit 21.

As shown in FIG. 2, the process unit 20 further includes the pressing cams 32. Each pressing cam 32 is provided on the drawer unit 21, and presses the corresponding developer cartridge 6 (see also FIG. 1) to direct the developer roller 5 toward the corresponding photosensitive drum 3 on the pressing surface 32D (see FIG. 4). Thus, the pressing force can be stably supplied to the developer cartridge 6 as compared with a case where a member provided outside the process unit 20 (on the side of the main body casing 2, for example) presses the developer cartridge 6, and the drawer unit 21 (the overall process unit 20) can be prevented from moving along with the developer cartridge 6 pressed by the pressing cam 32.

As shown in FIGS. 4 to 5B, the developer cartridge 6 can shift in the drawer unit 21 to the first attitude (see each developer cartridge 6 other than the developer cartridge 6M shown in FIG. 5A) pressed by the pressing surface 32D of the pressing cam 32 and the second attitude (see the developer cartridge 6M shown in FIG. 5A) released from the press of the pressing surface 32D and detachable from the drawer unit 21. When the developer cartridge 6 is in the first attitude, the developer roller 5 can come into pressure contact with the corresponding photosensitive drum 3, thereby developing the electrostatic latent image of the photosensitive drum 3 by smoothly feeding the toner to the photosensitive drum 3 and achieving excellent image formation.

Thus, the developer cartridge 6 takes the first attitude in the image formation. When the developer cartridge 6 is mounted to the drawer unit 21, therefore, the developer cartridge 6 first takes the second attitude and thereafter shifts to the first attitude, to be completely mounted to the drawer unit 21. When remaining in the second attitude (see the developer cartridge 6M shown in FIG. 5A), the developer cartridge 6 is not completely mounted to the drawer unit 21, and contact pressure of the developer roller 5 against the photosensitive drum 3 is weak (or the developer roller 5 detaches from the photosensitive drum 3) as compared with the case where the developer cartridge 6 is in the first attitude. Therefore, the developer roller 5 cannot smoothly feed the toner to the photosensitive drum 3, and it is difficult to form an excellent image.

When the process unit 20 is mounted to the main body casing 2 therefore, all developer cartridges 6 must be in the first attitudes, as shown in FIG. 1. If the user is required to confirm whether or not the developer cartridges 6 are in the first attitude when mounting the developer cartridges 6 to the drawer unit 21 and to bring the developer cartridges 6 into the first attitude if the same are in the second attitude, however, the printer 1 is inconvenient to handle. If the user forgets this procedure, the process unit 20 may be mounted to the main body casing 2 while the developer cartridges 6 are in the second attitude.

Therefore, the abutment portion 69 is provided on the main body casing 2, as shown in FIG. 6. When the process unit 20 is mounted to the main body casing 2, the abutment portion 69 abuts the developer cartridge 6 (see the developer cartridge 6M) in the second attitude, thereby bringing the developer cartridge 6 into the first attitude, as shown in FIG. 7. When the process unit 20 is mounted to the main body casing 2, therefore, the developer cartridge 6 having been in the second attitude automatically shifts to the first attitude in the process unit 20 without requiring the user to perform the aforementioned procedure, whereby the printer 1 can reliably form images in the state where all developer cartridges 6 of the process unit 20 are in the first attitude.

Consequently, handleability can be improved in the structure where the process unit 20 detachably equipped with the developer cartridges 6 is detachably mountable to the main body casing 2.

(2) Referring to FIGS. 4 to 5B, the boss 67 provided on the developer cartridge 6 is engaged with the pressing surface 32D of the pressing cam 32 to be pressed by the pressing surface 32D (see the boss 67 shown by the solid line in FIG. 4) when the developer cartridge 6 is in the first attitude (see each developer cartridge 6 other than the developer cartridge 6M shown in FIG. 5A). When the developer cartridge 6 is in the second attitude (see the developer cartridge 6M shown in FIG. 5A), on the other hand, the boss 67 is disengaged from the pressing surface 32D, to be released from the press of the pressing surface 32D (see the boss 67 shown by the dotted line in FIG. 4).

Thus, the developer cartridge 6 is pressed by the pressing surface 32D on the boss 67 (see the boss 67 shown by the solid line in FIG. 4) when the same is in the first attitude, and released from the press of the pressing surface 32D on the boss 67 (see the boss 67 shown by the dotted line in FIG. 4) when the same is in the second attitude, due to the simple structure of the boss 67 provided on the developer cartridge 6 to be engaged with and disengaged from the pressing surface 32D.

(3) As shown in FIG. 3, the bosses 67 are provided on both sides in the longitudinal direction (the width direction) of the developer roller 5 in each developer cartridge 6, while the pressing cams 32 (see also FIG. 4) having the pressing surfaces 32D are provided on the positions coinciding with both sides of each developer cartridge 6 mounted to the drawer unit 21 in the width direction.

Thus, the bosses 67 provided on both sides in the width direction are pressed by the pressing surfaces 32D (see FIG. 4) of the pressing cams 32 corresponding to the bosses 67 in each developer cartridge 6, whereby the attitude of each developer cartridge 6 pressed by the pressing surfaces 32D is not dispersed but stabilized on the respective positions in the width direction.

(4) The abutted portions 66 of the developer cartridge 6 abutted by the abutment portion 69 are provided on both end portions of the developer cartridge 6 in the orthogonal direction (the width direction) to the aforementioned prescribed direction (the anteroposterior direction) (see also FIG. 2).

Thus, the abutted portions 66 provided on both end portions of each developer cartridge 6 in the width direction are abutted by the abutment portion 69 (see FIG. 6), whereby each developer cartridge 6 abutted by the abutment portion 69 can stably shift from the second attitude to the first attitude (see the developer cartridge 6M shown in FIGS. 6 and 7) as compared with a case where only one abutted portion 66 is provided in the width direction.

(5) The abutted portions 66 provided on both end portions of the developer cartridge 6 in the width direction are arranged on the straight line L along the width direction, whereby the abutment portion 69 can simultaneously abut the abutted portions 66. Thus, the developer cartridge 6 can stably shift from the second attitude to the first attitude when abutted by the abutment portion 69 on the abutted portions 66.

(6) As shown in FIG. 6, the main body casing 2 is provided with the mounting port 71 passing the process unit 20 detachably mounted to the main body casing 2 therethrough, and the abutment portion 69 is arranged on the position exposed from the mounting port 71. Thus, the state of the abutment portion 69 abutting the abutted portions 66 of the developer cartridge 6 can be visually recognized.

(7) The developer cartridge 6 is inclined toward the upstream side (the front side) in the mounting direction (the direction toward the rear side) of the process unit 20 to the main body casing 2, thereby shifting from the second attitude to the first attitude (see the developer cartridge 6M shown in FIGS. 6 and 7).

The abutted portions 66 are arranged on the upstream side (the front side) in the mounting direction in each developer cartridge 6. Therefore, it takes time for the abutment portion 69 to abut the abutted portions 66 as compared with a case where the abutted portions 66 are arranged on the downstream side (the rear side) in the mounting direction, whereby the developer cartridge 6 can ensure a large quantity of change for shifting from the second attitude to the first attitude. More specifically, the height of the abutted portions 66 can be remarkably changed before and after the developer cartridge 6 shifts from the second attitude to the first attitude. Even if the second attitude is remarkably different from the first attitude, therefore, the abutted portions 66 are so abutted by the abutment portion 69 that the developer cartridge 6 can reliably shift from the second attitude to the first attitude.

(8) The process unit 20 is detachably mountable to the main body casing 2 of the printer 1 along the prescribed direction (the anteroposterior direction), as shown in FIG. 1.

The process unit 20 includes the drawer unit 21, the plurality of photosensitive drums 3 supported by the drawer unit 21 in the state parallelly arranged in the anteroposterior direction. on which the electrostatic latent images are formed and the plurality of developer cartridges 6 including the developer roller 5 opposed to the corresponding photosensitive drum 3 and detachably mountable to the drawer unit 21.

As shown in FIG. 2, the process unit 20 further includes the pressing cams 32. Each pressing cam 32 is provided on the drawer unit 21, and presses the corresponding developer cartridge 6 on the pressing surface 32D (see FIG. 4) to direct the developer roller 5 toward the corresponding photosensitive drum 3 (see also FIG. 1). Thus, the pressing force can be stably supplied to the developer cartridge 6 as compared with the case where the member provided outside the process unit 20 (on the side of the main body casing 2, for example) presses the developer cartridge 6, and the drawer unit 21 (the overall process unit 20) can be prevented from moving along with the developer cartridge 6 pressed by the pressing cam 32.

As shown in FIGS. 4 to 5B, the developer cartridge 6 can shift in the drawer unit 21 to the first attitude (see each developer cartridge 6 other than the developer cartridge 6M shown in FIG. 5A) pressed by the pressing surface 32D of the pressing cam 32 and the second attitude (see the developer cartridge 6M shown in FIG. 5A) released from the press of the pressing surface 32D and detachable from the drawer unit 21. When the developer cartridge 6 is in the first attitude, the developer roller 5 can come into pressure contact with the corresponding photosensitive drum 3, thereby developing the electrostatic latent image of the photosensitive drum 3 by smoothly feeding the toner to the photosensitive drum 3 and achieving excellent image formation.

Thus, the developer cartridge 6 takes the first attitude in the image formation. When mounted to the drawer unit 21, therefore, the developer cartridge 6 first takes the second attitude and thereafter shifts to the first attitude, to be completely mounted to the drawer unit 21. If remaining in the second attitude (see the developer cartridge 6M shown in FIG. 5A), the developer cartridge 6 is not completely mounted to the drawer unit 21, and the contact pressure of the developer roller 5 against the photosensitive drum 3 is weak (or the developer roller 5 detaches from the photosensitive drum 3) as compared with the case where the developer cartridge 6 is in the first attitude. Therefore, the developer roller 5 cannot smoothly feed the toner to the photosensitive drum 3, and it is difficult to form an excellent image.

When the process unit 20 is mounted to the main body casing 2, therefore, all developer cartridges 6 must be in the first attitude, as shown in FIG. 1. If the user is required to confirm whether or not the developer cartridges 6 are in the first attitude when mounting the developer cartridges 6 to the drawer unit 21 and to bring the developer cartridges 6 into the first attitude if the same are in the second attitude, however, the process unit 20 is inconvenient to handle. If the user forgets this procedure, the process unit 20 may be mounted to the main body casing 2 while the developer cartridges 6 are in the second attitude.

Therefore, each developer cartridge 6 includes the abutted portions 66 abutted by the main body casing 2 when the process unit 20 is mounted to the main body casing 2 while the developer cartridge 6 is in the second attitude, as shown in FIG. 6. When the process unit 20 is mounted to the main body casing 2, the developer cartridge 6 (see the developer cartridge 6M) in the second attitude is abutted by the main body casing 2 on the abutted portions 66 to shift from the second attitude to the first attitude, as shown in FIG. 7. When the process unit 20 is mounted to the main body casing 2, therefore, the developer cartridge 6 having been in the second attitude automatically shifts to the first attitude in the process unit 20 without requiring the user to perform the aforementioned procedure, whereby the process unit 20 can reliably form images in the state where all developer cartridges 6 of the process unit 20 are in the first attitude.

Consequently, handleability can be improved in the structure where the process unit 20 detachably equipped with the developer cartridges 6 is detachably mountable to the main body casing 2.

(9) The aforementioned prescribed direction (the detachable mounting direction of the process unit 20 to the main body casing 2) is a generally horizontal direction (more specifically, the anteroposterior direction), and each developer cartridge 6 is detachably mounted to the drawer unit 21 from above, as shown in FIG. 5A. As shown in FIG. 4, the developer cartridge 6 is provided with the bosses 67, and the pressing surface 32D of the pressing cam 32 presses each boss 67 when the boss 67 is positioned under the pressing surface 32D (see the boss 67 shown by the solid line in FIG. 4).

The boss 67 is positioned above the pressing surface 32D (see the boss 67 shown by the dotted line in FIG. 4) when the developer cartridge 6 is in the second attitude (see the developer cartridge 6M shown in FIG. 5A), while the boss 67 moves to the position under the pressing surface 32D (see the boss 67 shown by the solid line in FIG. 4) when the developer cartridge 6 shifts from the second attitude to the first attitude.

Thus, the developer cartridge 6 is pressed by the pressing surface 32D on the boss 67 (see the boss 67 shown by the solid line in FIG. 4) when the same is in the first attitude and released from the press of the pressing surface 32D on the boss 67 (see the boss 67 shown by the dotted line in FIG. 4) when the same is in the second attitude, due to the simple structure of the boss 67 provided on the developer cartridge 6 to be positioned above the pressing surface 32D when the developer cartridge 6 is in the second attitude and to move to the position under the pressing surface 32D when the developer cartridge 6 shifts from the second attitude to the first attitude.

<4. Modification>

While the photosensitive drums 3 are exposed by the laser beams emitted by the scanner unit 7 in the printer 1 as shown in FIG. 1, the photosensitive drums 3 may alternatively be exposed with an LED, in place of the scanner unit 7.

The embodiments described above are illustrative and explanatory of the invention. The foregoing disclosure is not intended to be precisely followed to limit the present invention. In light of the foregoing description, various modifications and alterations may be made by embodying the invention. The embodiments are selected and described for explaining the essentials and practical application schemes of the present invention which allow those skilled in the art to utilize the present invention in various embodiments and various alterations suitable for anticipated specific use. The scope of the present invention is to be defined by the appended claims and their equivalents.

What is claimed is:

1. An image forming apparatus comprising an image forming apparatus body and a photosensitive unit detachably mountable to the image forming apparatus body along a prescribed direction, wherein the photosensitive unit includes:

a frame;

a plurality of photosensitive bodies supported by the frame in a state parallelly arranged in the prescribed direction, on which electrostatic latent images are formed;

a plurality of cartridges including a developer carrier opposed to the corresponding photosensitive body and detachably mountable to the frame; and a pressing portion mounted to the frame and not to the cartridges, the pressing portion for pressing the cartridges to direct the developer carrier toward the corresponding photosensitive body, wherein each cartridge is configured to shift in the frame to a first attitude pressed by the pressing portion and a second attitude released from the press of the pressing portion and detachable from the frame, and the image forming apparatus body is provided with an abutment portion abutting the cartridge in the second attitude thereby bringing the cartridge into the first attitude when the photosensitive unit is mounted to the image forming apparatus body.

2. The image forming apparatus according to claim 1, wherein each cartridge is provided with a pressed portion, the pressed portion is engaged with the pressing portion to be pressed by the pressing portion when the cartridge is in the first attitude, and the pressed portion is disengaged from the pressing portion to be released from the press of the pressing portion when the cartridge is in the second attitude.

3. The image forming apparatus according to claim 2, wherein the pressed portions are provided on both sides of each cartridge in a longitudinal direction of the developer carrier, and the pressing portions are provided on positions coinciding with both sides of each cartridge mounted to the frame in the longitudinal direction.

4. The image forming apparatus according to claim 1, wherein abutted portions abutted by the abutment portion in each cartridge are provided on both end portions of the cartridge in an orthogonal direction to the prescribed direction.

5. The image forming apparatus according to claim 4, wherein the abutted portions provided on both end portions of the cartridge are arranged on a straight line along the orthogonal direction.

6. The image forming apparatus according to claim 4, wherein the image forming apparatus body is provided with a mounting port passing the photosensitive unit detachably mounted to the image forming apparatus body therethrough, and the abutment portion is arranged on a position exposed from the mounting port.

7. The image forming apparatus according to claim 6, wherein each cartridge shifts from the second attitude to the first attitude by inclining toward an upstream side in a mounting direction of the photosensitive unit to the image forming apparatus body, and the abutted portions are arranged on the upstream side in the mounting direction in each cartridge.

8. A photosensitive unit detachably mountable to an apparatus body of an image forming apparatus along a prescribed direction, comprising:

a frame;

a plurality of photosensitive bodies supported by the frame in a state parallelly arranged in the prescribed direction, on which electrostatic latent images are formed;

a plurality of cartridges including a developer carrier opposed to the corresponding photosensitive body and detachably mountable to the frame; and a pressing portion mounted to the frame and not to the cartridges, the pressing for pressing the cartridges to direct the developer carrier toward the corresponding photosensitive body, wherein each cartridge is configured to shift in the frame to a first attitude pressed by the pressing portion and a second attitude released from the press of the pressing portion and detachable from the frame, and includes an abutted portion abutted by the apparatus body when the photosensitive unit is mounted to the apparatus body while the cartridge is in the second attitude, and the cartridge in the second attitude is abutted by the apparatus body on the abutted portion thereby shifting from the second attitude to the first attitude when the photosensitive unit is mounted to the apparatus body.

9. The photosensitive unit according to claim 8, wherein the prescribed direction is a generally horizontal direction, each cartridge is detachably mounted to the frame from above, each cartridge is provided with a pressed portion, the pressing portion presses the pressed portion when the pressed portion is positioned under the pressing portion, the pressed portion is positioned above the pressing portion when the cartridge is in the second attitude, and the pressed portion moves to the position under the pressing portion when the cartridge shifts from the second attitude to the first attitude.

* * * * *